United States Patent [19]

Ikeuchi et al.

[11] Patent Number: 4,882,258

[45] Date of Patent: Nov. 21, 1989

[54] TONER FOR DEVELOPMENT OF ELECTROSTATIC IMAGE AND ELECTROSTATIC LATENT IMAGE DEVELOPER

[75] Inventors: Satoru Ikeuchi; Mitutaka Arai; Yuki Okuyama; Akitoshi Matsubara, all of Hino, Japan

[73] Assignee: Konica Corporation, Tokyo, Japan

[21] Appl. No.: 161,784

[22] Filed: Feb. 29, 1988

[30] Foreign Application Priority Data

Mar. 4, 1987 [JP] Japan ..... 62-49618
Mar. 5, 1987 [JP] Japan ..... 62-52427
Mar. 5, 1987 [JP] Japan ..... 62-52431

[51] Int. Cl.[4] ..... G03G 9/10; G03G 9/14; G03G 9/08

[52] U.S. Cl. ..... 430/108; 430/109; 430/110

[58] Field of Search ..... 430/108, 109, 110

[56] References Cited

U.S. PATENT DOCUMENTS 4,265,995 5/1981 Mammino ..... 430/109 X
4,367,275 1/1983 Aoki et al. ..... 430/109 X
4,414,322 11/1983 Miyakawa et al. ..... 430/109 X
4,457,998 7/1984 Gruber et al. ..... 430/110 X
4,623,604 11/1986 Takagiwa et al. ..... 430/109

FOREIGN PATENT DOCUMENTS 60-4946 1/1985 Japan ..... 430/109

*Primary Examiner*—Paul R. Michl
*Assistant Examiner*—Jeffrey A. Lindeman
*Attorney, Agent, or Firm*—Jordan B. Bierman; Bierman and Muserlian

[57] ABSTRACT

There are disclosed a toner for development of an electrostatic image which comprises containing (a) a mixture of a lower molecular weight polymer component and a higher molecular weight polymer component, and said lower molecular polymer component is a resin obtained by reacting a polymer containing a carboxylic acid component with a polyvalent metal compound to form cross-linking through a metal atom and (b) offset preventive agent; and also an electrostatic latent image developer which comprises (A) toner particles mainly comprising a resin obtained by reacting a carboxy group existing in a polymer component with a polyvalent metal compound and (B) resin coated-carrier particles coated with a fluorine-containing resin on a surface of a magnetic particle or inorganic fine particles.

18 Claims, No Drawings

TONER FOR DEVELOPMENT OF ELECTROSTATIC IMAGE AND ELECTROSTATIC LATENT IMAGE DEVELOPER

BACKGROUND OF THE INVENTION

This invention relates to a toner for the development of an electrostatic image for use in electrophotography and electrostatic latent image developers, more specifically it relates to a toner for the development of an electrostatic image which is excellent in blocking resistance and offset resistance as well as excellent fixability, particularly low temperature fixability, and a developer for developing an electrostatic latent image in electrophotography, electrostatic recording and electrostatic printing.

Generally speaking, in the dry system developing method, a powdery toner for development of electrostatic image charged is attached through electrical attraction onto an electrostatic latent image on a photosensitive member, then transferred onto a paper and fixed by hot rolls, etc.

Accordingly, such toner for development of electrostatic image is demanded to have various properties such as anti-blocking property (toner particles should not be aggregated), anti-offset property (toner should be firmly attached to paper). Particularly, recently, the toner for development of electrostatic image has been demanded to have good fixability at lower temperatures. In the prior art, for improvement of anti-offset property, it has been proposed to constitute the binder in the toner for development of electrostatic image of a resin comprising a polymer component with lower molecular weight and a polymer component with higher molecular weight (see Japanese Provisional Patent Publications No. 158340/1981, No. 16144/1981 and No. 202455/1983).

However, although an improvement of anti-offset property can be surely accomplished by introducing a polymer component with higher molecular weight into the toner for development of electrostatic image, if the glass transition point or softening point of the lower molecular weight polymer component is lowered in order to realize good fixability at lower temperature without causing lowering of the improved anti-offset property, anti-blocking property will be lowered.

On the other hand, if the proportion of the polymer component with lower molecular weight is increased by decreasing the proportion of the polymer component with higher molecular weight in order to realize fixability at lower temperature, anti-offset property will be worsened.

On the other hand, there is also a proposal, in which the binder is constituted of, for example, a styrene-acrylic acid type polymer, and its molecular weight distribution is made broader without particularly incorporating a polymer component with higher molecular weight as described above in this polymer, and moreover, by forming ion bonding of the carboxyl group in the polymer with metal atoms by the reaction with a metal compound to form a cross-linked structure through metal atoms, thus consequently realizing improvement of anti-offset property by effecting formation of substantially high polymer through the cross-linked structure, although having no special polymer component with higher molecular weight (see Japanese Provisional Patent Publications No. 110155/1981 and No. 110156/1981).

However, such toner for development of electrostatic image contains a large amount of a metal compound formulated therein, and therefore the metal compound formulated may exhibit a catalytic action depending on the condition, whereby the resin in the toner for development of electrostatic image may be readily gelled, and therefore there are problems such that it is difficult to determine preparation conditions for obtaining a desired toner for development of a metal compound, or that even the preparation condition can be determined, reproducibility is bad, etc.

In an electrophotographic method, after charging uniform surface charge to a photoreceptor comprising a photoconductive element in a dark place, by carrying out a development to form an electrostatic latent image, and thereafter the electrostatic latent image is developed to form a visual image.

Generally, such methods to develop an electrostatic latent image (hereinafter abbreviated to as "latent image") can be roughly classified into a wet development and a dry development. The wet development is a method which employs a liquid developer comprising dispersing various pigments or dyes in insulating organic liquids as fine particles, and the dry development is a method in which development is carried out by using a fine particle detecting powder called a toner which comprises dispersing a colorant such as a carbon black in a natural or synthetic resin. In the dry development, there are a so-called hair brush method, impression method and powder cloud method where a development is carried out by using a toner as a main component, and a so-called magnetic brush method and cascade method where a mixture of a toner and a carrier comprising a iron powder or glass beads is used as a developer.

By these developing method, toner particles having charges in the developer adhere to a latent image whereby a visual image is formed. This visual image is transferred onto a photoreceptor as it were by a pressure or a solvent vapor or to another support such as a transfer paper and thereafter fixed thereon.

Generally, a carrier constituting a developer can be roughly classified into a conductive carrier and an insulating carrier.

As the conductive carrier, oxidized or unoxidized iron powder has usually been employed. In the developer using the iron carrier, there are disadvantages that friction chargeability to the toner is unstable and fog is occurred in a visualized image obtained. That is, during a friction with the toner, the toner substance will likely adhere on the surface of the iron carrier particles whereby electric resistance of the carrier particles increase and bias current which is usually applied during development is lowered. And yet, friction chargeability of the carrier becomes unstable and as a result, image density of the visualized image formed is lowered and fog increases. Accordingly, when forming of image is continuously repeated with an electrophotographic device by using a developer employed the iron carrier, the developer will deteriorate within a little time and thus it is necessary to change the developer at earlier state whereby good image cannot be obtained continuously.

As the insulating carrier, in general, a carrier in which a surface of a carrier core material comprising a ferromagnetic substance such as iron, nickel, ferrite, etc.

is uniformly coated by an insulating resin is representative. In the developer using the insulating carrier, to fuse the toner substance on the surface of the carrier particles is less as compared with the case of the conductive carrier.

However, even in the developer comprising the insulating carrier and the toner, stable friction chargeability is not sometimes obtained. That is, in the developer comprising the toner and the carrier, friction contact between the carrier particles with each other, the toner particles with each other, the carrier particles and toner particle, and the carrier particles and/or the toner particles and a stirring membrane or a device wall in the developing devices, when the coating layer of the carrier is likely to cause wear out due to friction, stability of the friction chargeability of the carrier becomes lost. Further, when the toner particles is easily broken by mechanical impact or pressure, fog will likely be caused based on fine powder and when the toner particles is likely to cause wear out due to friction, friction chargeability of the carrier becomes unstable since the toner substance is likely adhere to the surface of the coating layer of the carrier.

Further, in friction contact between constituting particles of the developer, when fluidity of the developer is not good by restriction of freely movement of the particles due to large contact resistance, unevenness in sprinkle concentration is caused at the sleeve surface for developer transfer whereby development uniformity is lost and image quality becomes low. Also, since friction charge becomes insufficient, clear image with high density cannot be obtained.

Moreover, while a carrier in which the surface of a core material of a carrier is coated by a thermoplastic resin or a cross-linking resin has been developed, in this technique, since only characteristics of the toner is in question, stable friction chargeability cannot be obtained due to defect of the toner combinedly used. As a result, it has a disadvantage that good image without fog cannot be formed for many number of times.

Also, in recent years, from the demands of (a) to restrain overheating and deterioration of a copying machine, (b) to prevent deterioration due to heat of a photoreceptor, (c) to shorten warm up time required for elevating a temperature of a thermal roll, which is capable of fixing, from starting a fixing device, (d) to make little lowering of temperature of a thermal roll due to absorption of heat by a transfer paper whereby to enable a continuous copying over many times and (e) to heighten thermal stability, it is strongly required to enable to carry out the fixing processing in a state of lower temperature of the thermal roller by decreasing a consumption electric power. Accordingly, in the toner, it is required to well fixable even in a lower temperature.

And yet, in the toner, it is necessary to be stably exist without causing aggregation in the condition of usage or storage circumstances, that is, it should be excellent in blocking resistance. Further, in the thermal roller system which is preferred as the fixing method, an offset phenomenon, i.e., a phenomenon of which a part of the toner constituting an image at fixing transfers to a surface of the thermal roller and this is retransferred to a next sent transfer paper to stain an image, is likely caused. Thus, it is required to provide a characteristic of preventing the offset phenomenon, i.e., offset resistance to the toner. In order to obtain the above characteristics, various investigations have been carried out but those which can satisfy all the characteristics could not be obtained.

For example, in order to improve offset resistance, there is a proposal to constitute a resin to be used from a lower molecular weight polymer component and a higher molecular weight polymer component (Japanese Provisional Patent Publications No. 158340/1981, No. 16144/1981 and No. 202455/1983). However, when the high molecular weight polymer component is incorporated into the toner, offset generating temperature becomes high whereby it is convenient for offset resistance, but fixable temperature also increases at the same time so that it causes inconvenience for lower temperature fixing. To the contrary, in order to realize a fixing at lower temperature, if a glass transition temperature or softening temperature of the resin is lowered, not only the offset resistance becomes bad but also it provides defects of lowering in blocking resistance, lowering durability due to filming of the toner to the carrier particles, or generation of filming of carrier particles or a surface of the photoreceptor at high temperature and high humidity conditions.

Also, for example, in Japanese Provisional Patent Publications No. 178250/1982, No. 110155/1986 and No. 110156/1986, there are attempts to increasing offset resistance, blocking resistance and fixing temperature tolerance by a resin obtained by reacting a polymer having a carboxy group and a metal compound. However, the one component developer or the two components developer using an iron powdery carrier disclosed in the above publications is unstable in friction chargeability under high temperature and high humidity conditions. Also, it tends to cause filming to the carrier particles or a surface of the photoreceptor, and cleaning defects are caused due to fusing to a cleaning blade whereby good image cannot be obtained continuously and durability is lowered.

SUMMARY OF THE INVENTION

An object of the present invention is to cancel the above problems and to provide a toner for development of an electrostatic image, which is excellent in offset resistance and fixability at a lower temperature as well as high in non-aggregation property and capable of forming a stable and good image for a long term constantly.

Other object of the present invention is to provide a toner for development of an electrostatic image, which is capable of producing with good reproducibility without generating gel even if a metal compound is formulated and without causing unstableness of charging characteristics, and at the same time, excellent in characteristics of offset resistance, low temperature fixability, non-aggregation property, etc. whereby capable of forming a high quality image.

A third object of the present invention is to provide a developer suitably employed for a thermal roller system which is good in low temperature fixability, offset resistance and blocking resistance.

A fourth object of the present invention is to provide a developer which is stable in friction chargeability and is excellent in durability in which a good image without fog can be formed for many times.

A fifth object of the present invention is to provide a developer which generates no filming to carrier particles, a surface of a photoreceptor and a cleaning blade, etc. even at conditions of high temperature and high humidity, and is excellent in durability in which a stable image can be obtained even after many times of usage.

A sixth object of the present invention is to provide a developer excellent in fluidity which is capable of carrying out each operation such as supply, recovery or developing processing of the toner smoothly.

Summary of the present invention to accomplish the above objects is a toner for development of an electrostatic image which comprises (a) a mixture of a lower molecular weight polymer component and a higher molecular weight polymer component, and said lower molecular polymer component is a resin obtained by reacting a polymer containing a carboxylic acid component with a polyvalent metal compound to form cross-linking through a metal atom and (b) offset preventive agent.

Further, the above object can be accomplished by an electrostatic latent image developer which comprises (A) toner particles mainly comprising a resin obtained by reacting a carboxy group existing in a polymer component with a polyvalent metal compound and (B) resin coated carrier particles coated with a fluorine-containing resin on a surface of a magnetic particle or inorganic fine particles.

DESCRIPTION OF THE PREFERRED EMBODIMENTS

In one embodiment of the present invention, it is preferred that the main component resin of the above toner particles has a molecular weight distribution divided into at least two groups of a lower molecular weight polymer component and a higher molecular weight polymer component and a local maximum value at a lower molecular weight side is $1\times10^3$ to $2\times10^4$ and that at a higher molecular weight side is $1\times10^5$ to $2\times10^6$.

Further, the polymer of the above main component resin is a polymer obtained from a styrene type monomer, an acrylate type monomer and a half ester compound obtained by a half ester reaction of an acrylate type derivative having a hydroxyl group and a dicarboxylic acid compound, and it is preferred that the above half ester compound is a compound represented by the following formula (I):

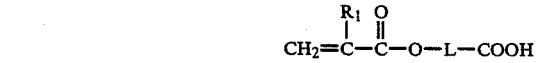

$$CH_2{=}\overset{R_1}{\overset{|}{C}}{-}\overset{O}{\overset{\|}{C}}{-}O{-}L{-}COOH \qquad (I)$$

In the formula, $R_1$ represents H or $CH_3$ and L represents a divalent linking group having an ester bonding in the molecular chain and having 3 or more carbon atoms, which may have a substituent(s).

Also, the above metal compound is preferably a zinc group metal compound or an alkaline earth metal compound Further, the above (B) inorganic fine particles are preferably hydrophobic silica fine particles.

According to the developer having such a constitution, since the toner appears a cross-linking structure by ion bonds with a metal, as compared with a resin cross-linked with covalent bonds, it is easily fused by heating so that fixability at lower temperature increases. Further, since it takes a cross-linking structure, the toner comprising said resin is tough and has excellent friction chargeability. Also, generation of fine particles, which cause fog, by breakage of the toner particles due to mechanical impact, is little. Moreover, in frictions of carrier particles, a stirring membrane, a wall of a device, a surface of a sleeve, etc., the resin component in the toner is less scraped off.

Further, since an inorganic fine particles are incorporated therein in order to improve fluidity, unevenness of sprinkle concentration at a surface of a sleeve of the developer is less and friction charging is sufficiently carried out whereby good image which is uniform and has sufficient image density can be obtained. Furthermore, the above inorganic fine particles have a function of removing a component contained in the toner which is accumulated on the carrier particles little by little by their abrasive effects, and thus, durability can be improved as compared with the conventional one more and more. Further, at the fixing, due to the presence of the above inorganic fine particles on a surface of the toner, they present between a fixing roller and the toner fused so that offset resistance of the toner can be improved and deterioration of the fixing roller can be prevented and thus lifetime of the fixing roller can be more elongated.

On the other hand, in the carrier particles, since they are coated by a resin containing fluorine, surface energy on the surface of the carrier particles becomes small so that smoothness on the surface of the carrier particles is high which fact leads to seldom adhesion of other substances. Also, transfer of the resin, etc. in the toner to a surface of the carrier particles, i.e., toner spent is difficult to occur whereby friction chargeability of the carrier becomes stable for a long period of time. And yet, since it is carrier particles coated with hydrophobic and low surface energy fluorine-containing resin, even in high temperature and high humidity circumferential conditions, the developer has a stable friction chargeability and durability substantially the same as in the normal temperature and normal humidity conditions.

Further, since a binder of the toner comprises a specific resin as a main component, the developer is excellent in offset resistance. At a thermal roller-fixing of the toner, no transfer of the fused toner to the fixing roller is caused, and thus, stain of the fixing roller and image stain will not likely be caused. Also, so-called toner filming in which a resin in the toner adheres to a surface of the photoreceptor to form a film is not caused, and a toner which forms filming with a little amount can be scraped off by the inorganic fine particles. Accordingly, the photoreceptor can be used for a long term stably. As results, clear image without fog can be formed for a long term stably and with a high speed.

In the following, the present invention will be described in more detail.

The above polymer to be used for a toner in the present invention is not particularly limited at all as far as it forms two peaks of a lower molecular weight polymer component and a higher molecular weight polymer component in the molecular weight distribution curve and the lower molecular weight polymer component contains at least a carboxylic acid component.

As the resin to be contained in the toner constituting a developer of the present invention, a resin obtained by reacting a carboxy group existing in the polymer component and a polyvalent metal compound shall be used.

The resin to be contained in said toner has a molecular weight distribution divided into at least two groups of a lower molecular weight polymer component and a higher molecular weight polymer component. And in the molecular weight distribution curve measured by Gel permeation chromatography (GPC), it is preferred that a local maximum value at a lower molecular weight side is $1\times10^3$ to $2\times10^4$ and that at a higher molecular weight side is $1\times10^5$ to $2\times10^6$. By providing such a constitution, fixing can be carried out at a lower temperature, and elasticity modulus at fusing can be heightened whereby offset resistance can further be improved. At the same time, blocking resistance can also be improved. Further, by addition of the higher molecular weight polymer component, the resin can be made tough so that generation of fine particles due to collision with the carrier or the photoreceptor can be prevented and stain of the carrier or a surface of the photoreceptor can be prevented.

For incorporation of a carboxy group to form an ion bond by reacting with a polyvalent metal compound, the carboxy group may only be incorporated into at least said lower molecular weight polymer component. The fine particle generated from the toner component by collision with the carrier particles or a surface of the photoreceptor are mainly based on a component of lower molecular weight and relatively brittle one. Therefore, such a lower molecular weight polymer component is cross-linked by at least a metal ion bond to make it toughness so that generation of fine particles which causes filming can be restrained.

As monomers for obtaining the polymer of the main component resin of the toner, it is preferred to employ polymers containing at least one selected from the group consisting of a styrene type monomer, an ester type monomer of acrylic acid or methacrylic acid as an essential component. In order to obtain a polymer having a carboxy group, in addition to the above monomer, a monomer selected from acrylic acid (including methacrylic acid) and its derivatives may be copolymerized. Preferred monomers having carboxy group to be copolymerized may include a half ester compound having a structure obtained by esterification reaction of an acrylate, a methacrylate or derivatives thereof having a hydroxyl group, with a dicarboxylic acid compound.

As stated above, if a carboxy group is incorporated at a position having a less effect to a main chain structure, steric hindrance of the chemical structure becomes little and a reaction with a polyvalent metal compound proceed effectively to form an ion bond which is efficient to accomplish the objects of the present invention, and can be made a good cross-linking structure.

As the above polymer, there may be mentioned, for example, an acryl type polymer or a styrene-acryl type polymer for the lower molecular weight polymer component and a styrene type polymer for the higher molecular weight polymer component, or an acryl type polymer or a styrene-acryl type polymer for the both of the lower molecular weight polymer component and the higher molecular weight polymer component. Among these, particularly preferred is both of the lower molecular weight polymer component and the higher molecular weight polymer component comprise a styrene-acryl type polymer.

As the styrene-acryl type polymer, preferred are, for example, those obtained from (a) a styrene type monomer, (b) an acrylate or methacrylate type monomer and (c) a half ester compound obtained by esterification reaction of an acrylic acid or methacrylic acid type derivative having a hydroxyl group with a dicarboxylic acid, or those obtained from (d) a styrene type component, (e) a first acrylic acid type component and (f) a second acrylic acid type component as a constituting unit, etc.

As the above (a) styrene type monomers, there may be mentioned, for example, styrene, o-methylstyrene, m-methylstyrene, p-methylstyrene, α-methylstyrene, p-ethylstyrene, 2,3-dimethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorostyrene, 3,4-dichlorostyrene, etc., among these, styrene is preferred.

The resin used for the toner should have a suitable crushability when preparing the toner and if the content of styrene in the copolymer is less than 30% by weight, crushability is tend to be lowered. Thus, the content of styrene is generally 30% by weight or more, preferably 40 by weight or more and the preferred upper limit is generally 95% by weight.

As the above (b) acrylate or methacrylate type monomers, there may be mentioned, for example, an alkyl ester of acrylic acid or methacrylic acid such as methyl acrylate, ethyl acrylate, propyl acrylate, n-butyl acrylate, isobutyl acrylate, n-octyl acrylate, dodecyl crylate, lauryl acrylate, 2-ethylhexyl acrylate, stearyl acrylate, methyl methacrylate, ethyl methacrylate, propyl methacrylate, n-butyl methacrylate, isobutyl methacrylate, n-octyl methacrylate, dodecyl methacrylate, lauryl methacrylate, 2-ethylhexyl methacrylate and stearyl methacrylate; 2chloroethyl acrylate, phenyl acrylate, methyl α-chloroacrylate, phenyl methacrylate, dimethylaminoethyl methacrylate, diethylaminoethyl methacrylate, etc. Among these, preferred are an alkyl ester of acrylic acid or methacrylic acid such as ethyl acrylate, propyl acrylate, n-butyl acrylate, methyl methacrylate, ethyl methacrylate, propyl methacrylate, n-butyl methacrylate, etc. and particularly n-butyl acrylate, methyl methacrylate and n-butyl methacrylate are preferred.

As the compound containing a carboxy group to be used for forming the above half ester compound, there may be mentioned, for example, an aliphatic dicarboxylic acid compound such as malonic acid, succinic acid, glutaric acid, etc.; or an aromatic dicarboxylic acid such as phthalic acid, etc., and a half ester compound can be obtained by estrification reaction with a derivative of acrylic acid or methacrylic acid having a hydroxyl group.

The above dicarboxylic acid compound may be substituted its hydrogen atom with a halogen group element, a lower alkyl group, alkoxy group, etc. and it may be an anhydride.

Further, as the above derivative of acrylic acid or methacrylic acid having a hydroxyl group, there may be those in which one or more moles of an alkylene oxide such as ethylene oxide, propylene oxide, etc. is added to acrylic acid or methacrylic acid; or may be a hydroxyalkyl ester obtained by reacting a divalent alcohol such as propylene glycol, etc. with acrylic acid or methacrylic acid.

Preferred half ester compound as the above is represented by the following formula (I):

$$CH_2{=}\overset{\overset{R_1}{|}}{C}{-}\overset{\overset{O}{\|}}{C}{-}O{-}L{-}COOH \qquad (I)$$

wherein $R_1$ represents a hydrogen atom or a methyl group and L represents a divalent linking group having an ester bonding in the molecular chain and having 3 or more carbon atoms, which may have a substituent(s).

Further preferred compounds are represented by the following formulae (II) to (V):

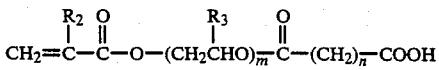

(II)

wherein $R_2$ and $R_3$ each represent a hydrogen atom or a methyl group, m is an integer of 1 to 14 and n is an integer of 0 to 8.

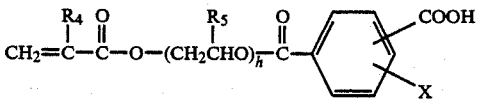

(III)

wherein $R_4$ and $R_5$ each represent a hydrogen atom or a methyl group, h is an integer of 1 to 14 and X represents a hydrogen atom, a halogen group element, a lower alkyl group or an alkoxy group.

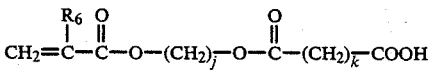

(IV)

wherein $R_6$ represents a hydrogen atom or a methyl group, j is an integer of 3 to 6 and k is an integer of 0 to 8.

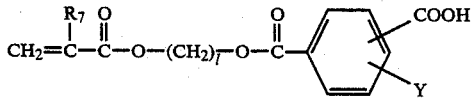

(V)

wherein $R_7$ represents a hydrogen atom or a methyl group, l is an integer of 3 to 6 and Y represents a hydrogen atom, a halogen group element, a lower alkyl group or an alkoxy group.

Among the half ester compounds represented by the above formulae (II) to (V), that represented by the formula (II) and (III) are particularly preferred.

As the half ester compound represented by the formulae (II) and (III), there may be mentioned, for example, succinic acid mono(meth)acryloyloxyethyl ester, succinic acid mono(meth)acryloyloxypropyl ester, glutaric acid mono(meth)acryloyloxyethyl ester, phthalic acid mono(meth)acryloyloxyethyl ester, phthalic acid mono(meth)acryloyloxypropyl ester, etc.

The polymer obtained from (a) a styrene type monomer, (b) an acrylate or methacrylate type monomer and (c) a half ester compound obtained by esterification reaction of an acrylic acid or methacrylic acid type derivative having a hydroxyl group with a dicarboxylic acid desirably comprises, as a ratio of contents of each monomer unit, 30 to 95% by weight, preferably 40 to 95% by weight of (a) a styrene type monomer, 4.5 to 70% by weight, preferably 5 to 50% by weight of (b) an acrylate or methacrylate type monomer and 0.5 to 30% by weight, preferably 1 to 20% by weight of (c) a half ester compound.

If the content of the above (a) styrene type monomer is less than 30% by weight, crushability of the toner for development of an electrostatic image may sometimes be lowered. If the content of the above (b) acrylate or methacrylate type monomer is less than 4.5 % by weight, fixability is lowered. Further, if the content of the above (b) acrylate or methacrylate type monomer is in excess of 70% by weight or the content of the above (c) half ester compound is less than 0.5% by weight, offset resistance at higher temperature fixing may sometimes be lowered and also blocking resistance and plasticizer resistance may sometimes be lowered.

As to the multicomponent type copolymer constituted by (d) a styrene type component, (e) a first acrylic acid type component and (f) a second acrylic acid type component, those as described in Japanese Provisional Patent Publication No. 158340/1981 may suitably be employed.

The resin to be incorporated in the toner for development of an electrostatic image of the present invention comprises a resin as a component obtained by reacting a polymer having a carboxy group and a polyvalent metal compound.

As a metal element in the above polyvalent metal compound, there may be mentioned Cu, Ag, Be, Mg, Ca, Sr, Ba, Zn, Cd, Al, Ti, Ge, Sn, V, Cr, Mo, Mn, Fe, Ni, Co, Zr, Se, etc.

Among these elements, preferred are Be, Mg, Ca, Sr and Ba of an alkaline earth metal and Zn and Cd of a zinc group element and particularly Mg and Zn are preferred.

As the polyvalent metal compounds, there may be mentioned, for example, fluorides, chlorides, hydrochlorides, bromides, iodides, oxides, hydroxides, sulfides, sulfites, sulfates, selenides, tellurides, nitrides, nitrites, phosphides, phosphites, phosphates, carbonates, orthosilicates, acetates, oxalates, or lower alkyl metal compounds such as methylated products, ethylated products of the above each elements. Among these, acetates and oxides are preferred.

An amount added of the above polyvalent metal compound may vary depending upon kinds and amounts of monomers constituting the polymer and cannot sweepingly said, but for example, when the polymer is composed of the lower molecular weight polymer component and the higher molecular weight polymer component with the above styrene type monomer, the above (meth)acrylate type monomer and the above half ester compound, it is sufficient in an amount of 0.1 to 1 mole based on 1 mole of the half ester compound used.

For reacting the polyvalent metal compound with the above polymer, for example, it is preferred that in a solution containing the above polymer obtained by polymerizing with the solution polymerization method, mixing the above metal compound or a solution dispersed therein the above metal compound, elevating the temperature for about 1 to 3 hours to remove the solvent and maintaining at the conditions of the temperature in the system being reached to 150° to 180° C. for 1 hour or more to complete the reaction. Depending on the situation, before initiating the polymerization, the metal compound may be added with the solvent in the reaction system, or the above polymer obtained by removing the solvent and the above metal compounds may be fused and kneaded by using a roll mill, kneader or extruder.

In the resin obtained by reacting the above polymer and the polyvalent metal compound thus obtained, a carboxy group contained in the polymer component and the metal atom are ion bonded and a kind of cross-linking structure is revealed due to the ion bond. This ion bond is far relaxed binding as compared with the covalent bond.

At any polymers, in this invention, it is desired that a local maximum value at a lower molecular weight polymer component is $1\times10^3$ to $2\times10^4$, particularly $2\times10^3$ to $1\times10^4$ and that at a higher molecular weight polymer component is $1\times10^5$ to $2\times10^6$, particularly $2\times10^5$ to $1\times10^6$.

If the molecular weight of the lower molecular weight polymer component is less than the above range, blocking resistance may sometimes be lowered and if it is larger than the above range, fixability may sometimes be lowered. Also, if the molecular weight of the higher molecular weight polymer component is less than the above range, offset resistance may sometimes be worsened and if it is larger than the above range, fixability may sometimes be worsened.

Further, from a view point of the molecular weight distribution, as the molecular weight distribution comprising the lower molecular weight polymer component and the higher molecular weight polymer component, a value of weight average molecular weight (Mw)/number average molecular weight (Mn) (hereinafter referred to "Mw/Mn") is desirably 3.5 or higher, preferably in the range of 4.0 to 40.

In the above polymer having two peaks of a lower molecular weight portion and a higher molecular weight portion in the molecular distribution, the content of the higher molecular weight polymer component is preferably 15% by weight or more, particularly 20 to 35% by weight based on the total polymer. If the content of the higher molecular weight polymer component is less than 15% by weight, lowering in offset resistance may sometimes be caused.

The polymer (or resin) of the present invention may be prepared by any of methods so long as it has two peaks in the molecular weight distribution. For example, the polymer having two peaks of distribution in the molecular weight as a result, by firstly effecting a first step polymerization to form either one of the higher molecular weight polymer component or the lower molecular weight polymer component, and then the either one of polymer formed is dissolved in monomers constituting another polymer component to provide polymer and a second step polymerization is effected to form another polymer component. As stated above, the polymer obtained by the two steps polymerization can be estimated to be a uniform mixture of the higher molecular weight polymer component and the lower molecular weight polymer component at the molecular level.

This two step polymerization can be carried out by the solution polymerization, suspension polymerization, emulsion polymerization, etc., and among them, the solution polymerization is preferred.

On the other hand, the polymer having two peaks of distribution in the molecular weight can be obtained by mixing the lower molecular weight polymer component and the higher molecular weight polymer component, but the polymer having two peaks distribution obtained by mixing may sometimes not be uniformly mixed at the molecular level so that as the polymer of the present invention, those obtained by the two step polymerization is particularly preferred.

Further, the polymer for the toner resin of the present invention is desirably a glass transition temperature of 50° to 80° C., a glass transition temperature of the lower molecular weight polymer component is 50° C. or higher, more preferably 55° C. or higher, and a glass transition temperature of the higher molecular weight polymer component is 65° C. or lower, more preferably 60° C. or lower. According to adjustment of the glass transition temperature, blocking resistance can be improved. Adjustment of the glass transition temperature can be easily carried out by suitably selecting kinds of monomers.

Furthermore, the polymer for the toner resin of the present invention may be incorporated a monomer unit such as vinyl acetate, vinyl propionate, vinyl chloride, ethylene, etc. in the range not inhibiting the objects of the present invention or a polymer of the above monomers may be blended therein. Also, a polyester resin or an epoxy resin may be incorporated therein.

The toner for development of the electrostatic image according to the present invention contains (a) the above specific resin and (b) an offset preventive agent.

As the above offset preventive agent, the offset preventives described in, for example, Japanese Provisional Patent Publications No. 65231/1974, No. 28840/1975, 252360/1985, No. 252366/1985, No. 254148/1985, No. 254150/1985, No. 254151/1985, No. 254154/1985 and No. 254155/1985 which have heretofore been conventionally known without any limitation.

Suitable offset preventives used in the present invention will be explained in more detail below.

In the present invention, as the offset preventive, nonpolar substance and/or polar substance can be used.

As the above non-polar substance, there may be mentioned, for example, polyolefins such as polyethylene, polypropylene, polybutene-1, etc.; high-melting point paraffin waxes such as microwax, Fischer-Tropsch wax, etc.; liquid paraffin; silicone varnishes such as methyl silicone varnish, phenyl silicone varnish, etc.; aliphatic fluorocarbon compounds such as a low polymerization degree compound of tetrafluoroethylene, hexafluoropropylene, etc. Among these compounds, particularly preferred is a polyolefin and particularly polypropylene.

As the above polar substance, there may be mentioned, for example, aliphatic acid esters such as polyvalent alcohol esters of aliphatic acid, higher alcohol esters of aliphatic acid, partial esters of aliphatic acid and polyvalent alcohol ester; alkylenebisaliphatic aid amides; higher aliphatic acids; aliphatic acid metal salts; surfactants containing fluorine, etc. In this invention, as the polar substance, polyolefins modified with a polar compound may be included.

Among the above various polar substances, alkylenebisaliphatic acid amides and aliphatic acid esters, etc. are preferred.

The above alkylenebisaliphatic acid amides are alkylenebidaliphatic acid amide compounds having a melting point of about 100° to 180° C. and represented by the following formula:

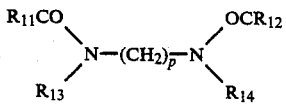

wherein $R_{11}$ and $R_{12}$ each may be the same or different and represent a saturated or unsaturated aliphatic hydrocarbon group having 10 or more carbon atoms; $R_{13}$ and $R_{14}$ may be the same or different and represent a hydrogen atom or —$OR_{15}$ group (where $R_{15}$ represents a saturated or unsaturated aliphatic hydrocarbon group); and p is an integer.].

The above alkylenebisaliphatic amide compounds can be commercially available as "Bisamide" (available from Nippon Suiso Kogyo K.K.), "Plastflow" (available from Nitto Kagaku K.K.), "Diamid 200 bis:" (available from Nippon Suiso Kogyo K.K.), "Rublon E" (available from Nippon Suiso Kogyo K.K.), "Alflow H50S" (available from Nippon Oil & Fats Co.), "Alflow V-60" (available from Nippon Oil & Fats Co.), "Amide-6L" (available from Kawaken Fine Chemical Co.), "Amide-7S" (available from Kawaken Fine Chemical Co.), "Amide-6H" (available from Kawaken Fine Chemical Co.), "Armowax-EBS" (available from Lion armer Co.), "Hoechst wax C" (available from Höechst Japan Co.), "Nobcowax-22DS" (available from Nobco Chemical Co.), "Adva wax-280" (available from Advance Co.), "Kao wax-EB" (available from Kao Co.), "Balicin-285" (available from Baker Caster Oil Co.), etc., and preferred is "Hoechst was C" (available from Höechst Japan Co.).

Also, the above aliphatic acid esters are aliphatic acid esters having a melting point of about 30° to 130° C. or partial saponified materials thereof, and there may be mentioned, for example, polyvalent alcohol esters of aliphatic acid, higher alcohol esters of aliphatic acid, partial ester mixed type esters of aliphatic acid and polyvalent alcohol, etc. Among these, higher alcohol esters of aliphatic acid is preferred.

The above higher esters of the aliphatic acid can be easily commercially available as, for example, "Sparm aceti" (available from Nippon Oil & Fats Co.), "Hoechst wax-E" (available from Höechst Japan Co.), "Hoechst wax-OP" (available from Höechst Japan Co.), etc., and among them, "Hoechst wax-E" (available from Höechst Japan Co.) is particularly preferred.

The above various offset preventive agents may be used alone or in combination of two or more kinds.

If a kind of the above various offset preventive agents is used, polyolefins, particularly, polyethylene and polypropylene are preferred. If two kinds of the above various offset preventive agents are combinedly used, a combination of a polyolefin and an alkylenebisaliphatic acid amide compound or an aliphatic acid ester is preferred, and particularly a combination of polypropylene and "Hoechest wax-E", or polyethylene and "Hoechst wax-C" is preferred.

An amount of the offset preventive agent is preferably 1 to 20 parts by weight, particularly 2 to 10 parts by weight based on 100 parts by weight of the above resin. If an amount is less than 1 part by weight, effect of improving offset property will sometimes lost and if it exceeds 20 parts by weight, fluidity becomes bad or adhesion to the carrier may sometimes be caused.

Also, when the offset preventive agent which comprises combination of a polyolefin and an alkylenebisaliphatic acid amide compound or an aliphatic acid ester is added, an amount to be added of the offset preventive agent which is combination of the polyolefin and the alkylenebisaliphatic acid amide compound or the aliphatic acid ester to the above resin is as mentioned above, but a formulation ratio of the polyolefin and the alkylenebisaliphatic acid amide compound or the aliphatic acid ester is preferred that the polyolefin is 30 to 70% by weight, particularly 40 to 60% by weight when the total of combination of the polyoleyin and the alkylenebisaliphatic acid amide compound or the aliphatic acid ester is made to 100.

The offset preventive agent is preferably mixed and kneaded with the above resin, a pigment or a dye, or other components at the stage of final preparation of a toner for development of an electrostatic image.

As the above pigment or dye, there may be mentioned carbon black, nigrosine dye, aniline blue, carconile blue, chrome yellow, ultramarine blue, Du'Pont oil red, quinoline yellow, methylene blue chloride, phthalocyanine blue, malachite green oxalate, lamp black, rose bengale, etc.

As the above other components, there may be mentioned, for example, a rosin-modified phenol formalin resin, an epoxy resin, a polyurethan resin, a cellulose resin, a polyether resin, a polyester resin, a styrene-butadiene resin, etc.

Kneading of the above resin, offset preventive agent, pigment or dye, or other components can be carried out by a kneader, a kneading roller, a closed system mixer, etc.

Next, the electrostatic latent image developer of the present invention will be described hereinbelow.

As the resin (polymer) to be used as a main component in the toner particles, those as mentioned hereinabove may be used.

In the present invention, the developer further contains resin-coated carrier particles coated with a fluorine-containing resin on a surface of a magnetic particle or inorganic fine particles.

In the present invention, as the coating resin containing fluorine for the carrier particles, it may preferably be a copolymer of the monomer represented by the following formula (VI) or a vinylidene fluoride-tetrafluoroethylene copolymer.

$$CH_2{=}\overset{\overset{R_8}{|}}{C}-\overset{\overset{O}{\|}}{C}-O\left(CH_2\right)_a\left(CF_2\right)_b-Z \qquad \text{(VI)}$$

wherein $R_8$ represents a hydrogen atom or a methyl group, a is an integer of 1 to 8 and b is an integer of 1 to 19.

As the preferred embodiment of the above formula (VI) of the present invention, those represented by the following formulae (VII) and (VIII) are preferred from view point of chargeability.

$$CH_2{=}\overset{\overset{R_9}{|}}{C}-COOCH_2C_rF_{2r+1} \qquad \text{(VII)}$$

$$CH_2{=}\overset{\overset{R_{10}}{|}}{C}-COOCH_2(CF_2)_sH \qquad \text{(VIII)}$$

In the above formulae, $R_9$ and $R_{10}$ each represent a hydrogen atom or a methyl group, r is an integer of 1 or 2 and s is an integer of 2 to 4.

As the further preferred embodiment of the present invention, there may be mentioned that the monomer presented by the formula (VI) is 1,1-dihydroperfluoroethyl methacrylate or 1,1,3-trihydroperfluoro-n-propyl methacrylate.

The coating resin of the carrier to be used in the present invention is a polymer comprising polymerizing the monomer component represented by the above formula (VI), and preferably a polymer itself which comprises containing 50% by weight or more of the monomer component or may be a composition containing said polymer. The description "containing said polymer" means it may be a copolymer containing other monomers or may be a blended material containing the above polymer or copolymer and other components and it may only contain the polymer of the present invention in the composition.

The monomer components to be used in the present invention may only be that represented by the above formula (IV), but it may be copolymerized with other components and the copolymer may be used.

The other component herein used may be mentioned, for example, acrylic (methacrylic) acid, methyl acrylate (methacrylate), ethyl acrylate (methacrylate), butyl acrylate (methacrylate), benzyl acrylate (methacrylate), acryl (methacryl) amide, cyclohexyl acrylate (methacrylate), glycidyl acrylate (methacrylate), hydroxyethyl acrylate (methacrylate), styrene, vinyl acetate, ethylene, propylene, isoprene, etc.

As the specific examples, the following may be mentioned but not limited by these.

[Exemplary compounds]

Polymer (1)

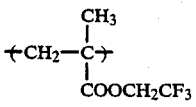

Polymer (2)

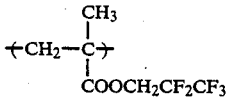

Polymer (3)

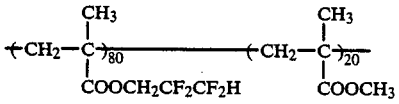

Polymer (4)

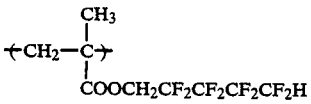

Polymer (5)

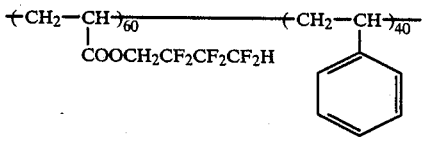

Polymer (6)

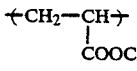

Polymer (7)

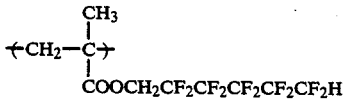

Polymer (8)

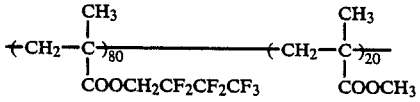

Also, a copolymerization molar ratio of vinylidene fluoride-ethylene tetrafluoride copolymer is desirably in the range of 72:25 to 95:5, preferably 75:25 to 87.5:12.5. If it exceeds the above range, there are defects that solubility in a solvent is bad and a film forming property of the coated resin is bad as well as film strength is small. That is, only in the limited molar composition ratio of the copolymer, solubility in a solvent becomes good and the film forming property and film strength are improved so that finally it has positive effects of improvement in durability, etc.

The composition for use of coating the carrier of the present invention may contain other materials than the above polymers and as the materials, there may be mentioned, for example, a polymer or copolymer composed of the compounds disclosed in Japanese Provisional Patent Publication No. 97435/1978.

In the present invention, a content of the polymer of the present invention in the composition is preferably 30% by weight or more, more preferably 50% by weight or more.

For preparation of the carrier to be used in the present invention, the above composition is dissolved in an organic solvent to prepare a coating solution, and after forming a coating layer by coating it on a surface of a carrier core material with, for example, a dry spray method, and further by heating or allowing to stand to obtain the carrier to be used in the present invention.

More specifically, for example, in a fluidized bed apparatus, the carrier core materials are elevated to a height of equilibrium by elevating pressure gas flow and by the time that the above core materials drop again, the above coating solution is spray coated. By repeatedly carrying out this coating, a coating layer is previously formed. This can be achieved since the specific polymer of the present invention, particularly the polymer obtained by monomers in which terminal Z in the formula (VI) is a hydrogen atom has high solubility in a solvent. When aggregated carriers are present, the carrie of the present invention having a desired film thickness can be finally obtained by screening them.

The organic solvent to be used in the above preparative method may by optional if it dissolve a resin mainly comprising the polymer of the present invention, and it may be used, for example, ketones such as acetone, methyl ethyl ketone, etc.; tetrahydrofuran, dioxane, dimethylsulfoxide, or mixtures thereof.

As the material for the carrier core material in the present invention, those used as the conventional carrier core material such as siliceous sand, a glass, a metal, etc may be used, but as preferred materials, there may be mentioned, for example, materials which intensively magnetize to direction of which a magnetic field is applied, such as ferrite and magnetite as well as a metal which show ferromagnetic property such as iron, cobalt, nickel, etc.; an alloy or a compound containing these metals, an alloy which do not show any ferromagnetic property but becomes show ferromagnetic property by conducting heat treatment under suitable conditions such as an alloy of a kind of so-called Heusler's alloy such as manganese-copper-aluminum or manganese-copper-tin, etc.; or chromium dioxide, etc. A particle size of the carrier core material is preferably 30 to 1000 μm, more preferably 50 to 500 μm.

Also, a film thickness of the coating layer in the present invention is preferably 0.05 to 20 μm, particularly preferably 0.1 to 2 μm.

The carrier of the present invention is preferably those providing a charge of 5 to 40 μC/g in an absolute value to a toner together employed under usual use conditions.

Further, in the present invention, as a fluidity improver, inorganic fine particles are to be mixed.

As the above inorganic fine particles to be used in the present invention, it is preferred that an average particle size of a primary particle is 5 to 50 mμ. Also, a specific surface area by the BET method thereof is preferably 40 to 500 $m^2/g$. Mixing ratio of the inorganic fine particles in the toner is preferably 0.01 to 5% by weight, more preferably 0.01 to 2.0% by weight. As the inorganic fine particles, there may be mentioned, for example, colloidal silica, hydrophobic-treated silica, titanium dioxide, aluminum oxide, antimony trioxide, magnesium oxide, serium oxide, zinc oxide, zirconium oxide, barium titanate, calcium titanate, strontium titanate, magnesium titanate, calcium silicate, magnesium silicate, sodium silicate, zinc silicate, aluminum silicate, barium sulfate, barium carbonate, calcium carbonate, silicon carbide, silicon nitride, etc. and hydrophobic treated above materials with a silan coupling agent, a titanium coupling agent, a silicone oil, a silicone oil having an amine at a side chain. Among these, silica, alumina, titanium oxide and hydrophobic-treated these material are preferred. Particularly preferred is a hydrophobic-treated hydrophobic silica fine particle.

The silica fine particle herein mentioned is a fine particle having an Si-O-Si bond and it includes those obtained by both of the dry method and the wet method. Also, it may be any of aluminum silicate, sodium silicate, potassium silicate, magnesium silicate or zinc silicate, in addition to anhydrous silicon dioxide, but those containing 85% by weight or more of $SiO_2$.

As the specific examples of these silica fine particles, various commercially available silica may be mentioned, but those having a hydrophobic group at a surface thereof is preferred. There may be mentioned, for example, AEROSIL R-972, R-974, R-805, R-812 (all available from Aerosil Co.), Taranox 500 (available from Talco Co.) and the like.

While the toner of the present invention comprises containing a colorant in the aforesaid specific resin, a magnetic material or a property improver may be added, if necessary. As the colorant, there may be mentioned carbon black, Nigrosine dye (C.1. No. 50415B), Aniline Blue (C.I. No. 50405), Carco Oil Blue (C.I. No. azoic Blue 3), Chrome Yellow (C.I. No. 14090), Ultramarine Blue (C.I. No. 77103), Du'pont Oil Red (C.I. No. 26105), Quinoline Yellow (C.I. No. 47005), Methylene Blue Chloride (C.I. No. 52015), Phthalocyanine Blue (C.1. No. 74160), Malachite Green Oxalate (C.I. No. 42000), Lamp Black (C.I. No. 77266), Rose Bengale (C.I. No. 45435), mixtures thereof, and others. These colorants should be incorporated in an amount enough to form a visible image having an ample density, and the amount of the colorant is usually within the range of 1 to 20 parts by weight based on 100 parts by weight of the resin.

As the above magnetic material, there may include ferromagnetic materials such as ferrite, magnetite as well as iron, cobalt, nickel, alloys thereof and compounds including these elements; alloys which contain no ferromagnetic materials but will show a ferromagnetism by virtue of a proper heat treatment, e.g., Heusler's alloys containing manganese and copper, such as a manganese-copper-aluminum alloy and a manganese-copper-tin alloy; and chromium dioxide. The magnetic substance is uniformly dispersed into the binder in the form of a fine powder, each particle constituting the powder having an average particle diameter of 0.1 to 1 micron. An amount of the magnetic material to be added is within the range of 20 to 70 parts by weight, preferably 40 to 70 parts by weight per 100 parts by weight of the toner.

The carrier particles when the present invention comprises two components developer may be coated with a silicone resin, a fluorine resin, etc. As the resin to be used for coating, there may be mentioned, in addition to the above two resins, for example, an acrylic resin, a styrene resin, an epoxy resin, a urethane resin, a polyamide resin, a polyester resin, an acetal resin, a polycarbonate resin, a phenol resin, a vinyl chloride resin, a vinyl acetate resin, a cellulose resin, a polyolefin resin, a copolymer resin or formulated resin of the above resins, and the like.

Among them, a silicone resin-coated carrier is particularly preferred. By coating with the silicone resin, a surface energy of the carrier particle surface becomes small so that slip property of the carrier surface is high and other substances will hardly adhere to the surface.

Accordingly, adhesion of components such as the resin in the toner to the surface of the carrier particles, that is, toner spent will hardly occur and a friction chargeability of the carrier and the toner becomes stable for a long term. And yet, since the coating is due to the silicone resin which is hydrophobic and low surface energy, even in the high temperature and high humidity circumferential conditions, it has substantially the same friction charging stability and durability as in the normal temperature and normal humidity conditions.

As such a silicone resin, it is not specified but condensation reaction type silicone resin which cures, for example, by the following reactions (1) and (2) can particularly preferably be used.

(1) Dehydration condensation reaction under heating

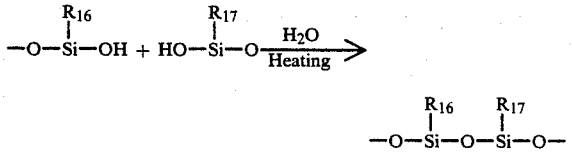

(2) Humidity curing reaction under room temperature

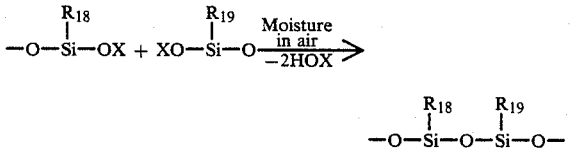

wherein OX represents an alkoxy group, a ketoxime group, an acetoxy group or an amonoxy group, and $R^{16}$ to $R^{19}$ each represent an alkyl group.

In the above condensation reaction type silicone resin, particularly preferred is that wherein the substituent is a methyl group. In the coating layer obtained by the condensation reaction type silicone resin where the substituent is a methyl group, the carrier which has close structure, remarkably good in water repellency and good in humidity resistance can be obtained.

As the condensation reaction type silicone resin, either one of the heat-curable type silicone resin or the normal temperature-curable type silicone resin may be used. When the heat-curable type silicone resin is used, it is necessary to heat at about 200° to 250° C., and when the normal temperature-curable type silicone resin is used, it is not particularly necessary to heat at a high temperature but may be heated in the range of 150° to 220° C. in order to promote curing.

The normal temperature-curable type silicone resin is a silicone resin which cures at a temperature of 20° to 25° C. or so or a temperature slightly higher than the above under conventional circumferential conditions and it is not require the temperature exceeding 100° C. for curing.

As the condensation reaction type silicone resin which is commercially available, there may be mentioned, for example, the following ones.

"SR-2400", "SR-2406", "SR-2410" and "SR-2411" (all available from Toray Silicone Co.), "KR-152", "KR-271", "KR-251", "KR-220", "KR-255" (all available from Shin-etsu Kagaku Kogyo K.K.).

For formation of the coating layer, the silicone resin may be used alone or in combination, or those which are mixed other resin with the silicone resin may be used. As other resins, there may be mentioned, for example, an acrylic resin, a styrene resin, an epoxy resin, a urethane resin, a polyamide resin, a polyester resin, an acetal resin, a polycarbonate resin, a phenol resin, a vinyl chloride resin, a vinyl acetate resin, a cellulose resin, a polyolefin resin, a copolymer resin or formulated resin of the above resins and the like.

Also, a weight ratio of silicon and carbon: Si/C in the silicone resin is preferably 1.7 to 2.2. If the value is in excess of the above range, chargeability is easily effected by the change of humidity and the coating layer becomes brittle. On the other hand, if the value is too small, the coating layer becomes soft.

In order to improve humidity resistance and releasability, a silicone oil may be added in the silicone resin.

As the carrier core material which is used for coating of the silicone resin, there may be mentioned, for example, a magnetic metal such as iron, nickel, cobalt, etc.; a ferromagnetic oxide such as ferrite, magnetite, etc.; copper, carborandom, glass beads, and others. As the carrier core material it is usually employed that having a volume average particle size of 1 to 1000 μm, particularly 5 to 200 μm is preferred.

As the specific coating method of the carrier particles, the dipping method in which a powder of the carrier core material is dipped in a coating solution, the spray method in which a coating solution is sprayed to the carrier core material, the fluidized bed method in which the carrier core material is loated by fluidizing air and coating solution is sprayed to the carrier core material in the fluidized state, the method in which the carrier core material is carried out rolling treatment on a surface existing a coating solution, and the like. Particularly, when the fluidized bed method is used, a uniform coating film can be formed on the surface of the carrier core material so the coating layer can be formed stably. As to the coating method due to the fluidized bed method, there has been disclosed, for example, in Japanese Provisional Patent Publication No. 155049/1979.

Further, as the property improver to be used in the present invention, there may be mentioned a fixability improver, a charge controlling agent, and others. As the fixability improver, there may be mentioned, for example, polyolefin, aliphatic acid metal salts, aliphatic acid esters and aliphatic acid ester type waxes, partially saponified aliphatic acid esters, higher aliphatic acids, higher alcohols, fluid or solid paraffin waxes, polyamide type waxes, polyvalent alcohol esters, silicone varnishes, aliphatic fluorocarbons, etc. Particularly, waxes having a softening point (the ring ball method; JIS K 2531) of 60° to 150° C. are preferred. Such a fixability improver has, in addition to the above effect, an effect of preventing adhesion to the carrier particles so that it has an effect of improving durability.

One example of the preferred preparation method of the toner according to the present invention is mentioned below. First, a material resin of the binder or, if necessary, toner components such as a colorant are added thereto is fused and kneaded with, for example, an extruder, after cooling, pulverized with a jet mill, etc., and classified to obtain a desired particle size of the toner. Or else, the fused and kneaded material by the extruder is in the state of fusing sprayed or dissipated in a solution to obtain a desired particle size of the toner.

As the image forming method using the developer of the present invention, formation and development of a latent image is effected by the conventional electrophotographic copying machine, a toner image obtained is electrostatically transferred to a transfer paper and it is fixed by a heating roller fixing apparatus which is set the temperature of a heat roller at a constant temperature to form a copied image.

The toner of the present invention is particularly preferably employed for carrying out a fixation of which a contact time of the toner on the transfer paper and the heat roller is within 1 second, particularly within 0.5 second.

According to the present invention, since the main component comprises a resin cross-linked through metal atoms obtained by the reaction between a polymer comprising a polymer component with lower molecular weight and a polymer component with higher molecular weight, at least said lower molecular weight polymer component containing a carboxylic acid component, and a polyvalent metal compound, it is possible to provide a toner for development of electrostatic image which can realize good fixability at low temperature by increasing the content of the polymer component with lower molecular weight and yet can prevent lowering in anti-offset property by mild cross linked bonding of the polymer component with lower molecular weight through metals.

Besides, in the present invention, since a polymer with a bimodal molecular weight distribution is used, the polymer component with higher molecular weight also contributes to anti-offset property, and therefore, the amount of the polyvalent metal compound reacted with the polymer can be also decreased. Accordingly, a toner for development of electrostatic image with stable charging characteristics can be provided.

Also, the toner for development of electrostatic image is smaller in the amount of the polyvalent metal compound formulated, whereby there occurs no gelation and the toner can be produced with good reproducibility. Thus, the toner for development of electrostatic image can be prepared under stable preparation condition.

Further, according to the developer of the present invention, as compared with the conventional toner, fixing at a lower temperature of 25° to 40 ° C. can be possible so that cost reduction due to simplification of the fixing apparatus and remarkable durability improvement of a fixing roller can be accomplished. Moreover, by combinedly using a carrier particle and an inorganic fine particle, increase in durability as well as improvement in temperature and humidity resistance can be effected by the synergistic effect of the both components, whereby under any circumferential conditions, sharp and stable image can be provided.

EXAMPLES

In the following, Examples of the present invention will be explained but the present invention is not limited to these Examples.

PREPARATION EXAMPLE 1

A 2-liter separable flask charged with 400 ml of toluene and the air in the flask was replaced by nitrogen.

Then, toluene in the flask was heated under reflux.

Subsequently, into the flask were charged 192 g of styrene, 48 g of n-butyl acrylate and 0.5 g of benzoyl peroxide, and polymerization reaction of the first stage was conducted under reflux over 12 hours to prepare a polymer component with higher molecular weight.

After elapse of 12 hours, into the above flask was added dropwise over 2 hours a mixture of 164 g of styrene, 56 g of n-butyl acrylate, 80 g of monoacryloyloxyethyl succinate and 8 g of benzoyl peroxide to carry out the polymerization reaction of the second stage.

After completion of the dropwise addition of the above mixture, the polymerization reaction of the second stage was continued at the reflux temperature for additional one hour to prepare a polymer component with lower molecular weight. Then, 8 g of zinc oxide was added into the above flask and the mixture was stirred for 1 hour.

Then, toluene which is the solvent was evaporated under reduced pressure to give a resin (1) which is the reaction product between a polymer having side chains having carbxyl group and zinc oxide.

The molecular weight distribution of the resin (1) was measured by HLC-802UR (column: HG type of TSK-GEL), and consequently the resin (1) was found to have local maximum values at $4.0\times10^5$ and $7\times10^3$, thus exhibiting a bimodal molecular weight distribution.

COMPARATIVE PREPARATION EXAMPLE 1

A resin (2) was prepared in the same manner as in the above preparation example 1, except for:

preparing a polymer component with lower molecular weight by use of 880 g of styrene and 120 g of n-butyl methacrylate in place of 164 g of styrene, 56 g of n-butyl acrylate and 80 g of monoacryloyloxyethyl succinate, and not using 8 g of zinc oxide.

When this resin (2) was examined for its molecular weight distribution similarly as described in the above preparation example 1, it was found to have maximum values at $2.8\times 10^5$ and $5.3\times10^3$.

COMPARATIVE PREPARATION EXAMPLE 2

A 2-liter separable flask charged with 400 ml of toluene, and the air in the flask was replaced by nitrogen.

Then, toluene in the flask was heated under reflux.

Subsequently, solution polymerization was carried out, while adding dropwise into the flask a mixture comprising 750 g of styrene, 200 g of n-butyl acrylate, 50 g of monoacryloyloxyethyl succinate and 10 g of benzoyl peroxide over 2.5 hours.

After completion of the dropwise addition of the above mixture, the polymerization reaction was continued at the reflux temperature for additional 1 hour. Then, 18 g of zinc oxide was added into the above flask.

Then, toluene which is the solvent was evaporated under reduced pressure to give a resin (3) which is the reaction product between a polymer having side chains having carboxyl group and zinc oxide.

When the molecular weight distribution of the resin (3) was measured similarly as in the above preparation example 1, the resin (3) was found to have a local maximum value at 2.0 x 1014, thus exhibiting a single mode of molecular weight distribution.

In preparation of the resin (3), gelation of the polymer frequently occurred, whereby the resin (3) could not be obtained stably, with reproducibility being poor.

EXAMPLE 1

100 parts by weight of the resin (1) obtained in the above preparation example 1, 10 g of carbon black (trade name: "MOGAL L", available from Cabot Co.) and 3 parts by weight of polypropylene (660P, available from Sanyo Kasei Co.) were kneaded under heating and coarsely pulverized after cooling, followed further by micropulverization by means of a jet mill to give a toner (1) for development of electrostatic image having an average particle size of about 11 μm. The developer exhibited good triboelectric charging quantities.

5 g of this toner for development of electrostatic image was collected in a watch glass and allowed to stand in a thermometer of 55° C. for 4 hours. After 4 hours, there is no aggregation of the toner and can be observed a good blocking resistance.

A developer was obtained by mixing 4 parts of the toner (1) for development of electrostatic image and 96 parts or iron powder carrier with an average particle size of about 50 to 80 μm.

The developer was mounted in a electrophotogrpahic copying machine ("U-Bix 1800", available from Konishiroku Photo Industry Co., Ltd.), and presence of generation of offset was tested by varying the setting temperature of the fixing roller as shown in Table 1. More specifically, presence of generation of offset was evaluated by whether the image was transferred onto the fixing roller and the offset image was retransferred onto the paper after the second rotation of the roller et seq, when an unfixed image was passed through hot roll fixer. The results are shown in Table 1.

Also, by varying the temperature of the fixing roller, fixability of the developer according to the toner (1) for development of electrostatic image was evaluated.

More specifically, images fixed by the fixing roller under various setting temperature were rubbed under a certain load by means of rubbing testing machine, and the residual percentage of the image was measured by a microdensitometer. The results are shown in Table 2.

As shown in Tables 1 and 2, the toner for development of electrostatic image according to the present invention exhibits a minimum fixing temperature of 150 ° C. and a fixing temperature range capable of forming a high density image without causing offset of 150° to 230 ° C.

EXAMPLE 2

A toner (II) for development of electrostatic image was prepared in the same manner as in Example 1 except that, as an offset preventive agent, 3 parts by weight of polypropylene and 3 parts by weight of "Höechst wax C" were used in place of 3 parts by weight of the above polypropylene.

In the same manner as in the above Example 1, presence of generation of offset and fixability of the toner (II) for development of electrostatic image were evaluated.

The results were shown in Tables 1 and 2.

EXAMPLE 3

A toner (III) for development of electrostatic image was prepared in the same manner as in Example 1 except that, as an offset preventive agent, 4 parts by weight of polypropylene and 3 parts by weight of "Höechst wax E" were used in place of 3 parts by weight of the above polypropylene.

In the same manner as in the above Example 1, presence of generation of offset and fixability of the toner (III) for development of electrostatic image were evaluated.

The results were shown in Tables 1 and 2.

EXAMPLE 4

A toner (IV) for development of electrostatic image was prepared in the same manner as in Example 1 except that, as an offset preventive agent, 3 parts by weight of polyethylene wax (Mitsui high wax, available from Mitsui Sekiyu Kagaku Co.) and 3 parts by weight of "Höechst wax C" were used in place of 3 parts by weight of the above polypropylene.

In the same manner as in the above Example 1, presence of generation of offset and fixability of the toner (IV) for development of electrostatic image were evaluated.

The results were shown in Tables 1 and 2.

COMPARATIVE EXAMPLE 1

A toner (V) for development of electrostatic image was prepared in the same manner as in Example 1 except that, 100 parts by weight of the resin (2) prepared in Comparative preparation example 1 was used in place of 100 parts by weight of the resin (1) used in Example 1.

In the same manner as in the above Example 1, presence of generation of offset and fixability of the toner (V) for development of electrostatic image were evaluated.

The results were shown in Tables 1 and 2.

COMPARATIVE EXAMPLE 3

A toner (VI) for development of electrostatic image was prepared in the same manner as in Example 1 except that, 100 parts by weight of the resin (3) prepared in Comparative preparation example 2 was used in place of 100 parts by weight of the resin (1) used in Example 1.

In the same manner as in the above Example 1, presence of generation of offset and fixability of the toner (VI) for development of electrostatic image were evaluated.

The results were shown in Tables 1 and 2.

COMPARATIVE EXAMPLE 3

A toner (VII) for development of electrostatic image was prepared in the same manner as in Example 1 except for adding polypropylene.

In the same manner as in the above Example 1, presence of generation of offset and fixability of the toner (VII) for development of electrostatic image were evaluated.

The results were shown in Tables 1 and 2.

TABLE 1

| | Kind of resin | Presence of offset preventive agent | Kind of toner | Temperature of fixing roller (°C.) | | | | | | | | |
|---|---|---|---|---|---|---|---|---|---|---|---|---|
| | | | | 130 | 140 | 150 | 160 | 170 | 200 | 210 | 220 | 230 |
| Example 1 | resin (1) | Do | toner (I) | X | X | O | O | O | O | O | O | X |
| Example 2 | resin (1) | Do | toner (II) | X | O | O | O | O | O | O | O | X |
| Example 3 | resin (1) | Do | toner (III) | X | O | O | O | O | O | O | O | X |
| Example 4 | resin (1) | Do | toner (IV) | X | X | O | O | O | O | O | O | X |
| Comparative example 1 | resin (2) | Do | toner (V) | X | X | O | O | O | O | O | O | X |
| Comparative example 2 | resin (3) | Do | toner (VI) | X | X | O | O | O | O | O | X | X |
| Comparative example 3 | resin (2) | None | toner (VII) | X | X | O | O | O | O | O | X | X |

Note:
X . . . offset generated,
O . . . offset not generated.

TABLE 2

| | Kind of resin | Presence of offset preventive agent | Kind of toner | Temperature of fixing roller (°C.) | | | | | | | | |
|---|---|---|---|---|---|---|---|---|---|---|---|---|
| | | | | 130 | 140 | 150 | 160 | 170 | 200 | 210 | 220 | 230 |
| Example 1 | resin (1) | Do | toner (I) | X | X | O | O | O | O | O | O | O |
| Example 2 | resin (1) | Do | toner (II) | X | O | O | O | O | O | O | O | O |
| Example 3 | resin (1) | Do | toner (III) | X | O | O | O | O | O | O | O | O |
| Example 4 | resin (1) | Do | toner (IV) | X | X | O | O | O | O | O | O | O |
| Comparative example 1 | resin (2) | Do | toner (V) | X | X | X | X | O | O | O | O | O |
| Comparative example 2 | resin (3) | Do | toner (VI) | X | X | O | O | O | O | O | X | X |

TABLE 2-continued

| | Kind of resin | Presence of offset preventive agent | Kind of toner | Temperature of fixing roller (°C.) | | | | | | | | |
|---|---|---|---|---|---|---|---|---|---|---|---|---|
| | | | | 130 | 140 | 150 | 160 | 170 | 200 | 210 | 220 | 230 |
| Comparative example 3 | resin (2) | None | toner (VII) | X | X | O | O | O | O | O | O | O |

Note:
X . . . bad in fixability,
O . . . good in fixability.

Preparation of carrier

Each of 15 g of exemplary polymers (1) to (5) was dissolved in 500 ml of a mixed solvent of acetone-methyl ethyl ketone (1:1) to prepare a coating solution, and according to this coating solution, 1 kg of spherical iron powder "DSP-135C" (trade name, available from Dowa Teppun Kogyo Co.) which was a carrier core material was coated with a fluidized bed apparatus to prepare a carrier of the present invention having a film thickness of about 2 μm. They are called as "Carrier A", "Carrier B", "Carrier C", "Carrier D" and "Carrier E".

Carrier F

In 500 ml of a mixed solvent of acetone-methyl ethyl ketone (1 : 1) were dissolved 6 g of vinylidene fluoride-tetrafluoroethylene copolymer "VT-100" (trade name, copolymerization molar ratio; 80 : 20, intrinsic viscosity; 0.95 dl/g) (available from Daikin Kogyo Co.) and 6 g of methyl methacrylate copolymer "Acrypet MF" (trade name, available from Mitsubishi Rayon Co.) to prepare a coating solution and according to this coating solution, 1 kg of spherical iron powder "DSP-135C" (trade name, available from Dowa Teppun Kogyo Co.) which was a carrier core material was coated with a fluidized bed apparatus to prepare Carrier F having a film thickness of about 2 μm.

Comparative carrier (a)

By coating a styrene-methyl methacrylate copolymer resin onto a core particle of Carrier A, comparative carrier (a) was obtained.

Comparative carrier (b)

EFV 250/400 (trade name, available from Nippon Teppun Co.) which is iron particles is made comparative carrier (b).

Synthesis of toner resin

SYNTHESIS EXAMPLE 1

In a separable flask with a content of 3 liter and equipped with a thermometer, a stirrer, a nitrogen gas inlet tube and a flow down type condenser was charged with 500 ml of toluene and after inside of the flask was made inactive atmosphere by introducing nitrogen gas from the gas inlet tube, it was heated to a reflux temperature of toluene by using an oil bath. Subsequently, a solution comprising 225 g of styrene, 60 g of n-butyl acrylate, 15 g of methyl methacrylate and 0.9 g of benzoyl peroxide was charged into the flask and reacted at a reflux temperature for 14 hours to prepare a higher molecular weight polymer.

Next, in the flask containing the above higher molecular weight polymer solution, a solution of 470 g of styrene, 105 g of n-butyl acrylate, 35 g of methyl methacylate, 70 g of monoacryloyloxyethyl succinate and 35 g of benzoyl peroxide was added dropwise to carry out the polymerization reaction. After dropwise addition of the above solution, polymerization reaction was carried out for further 4 hours to obtain a lower molecular weight polymer.

Next, 7 g of zinc oxide was added into the solution comprising the above higher molecular weight polymer and the lower molecular weight polymer, and reaction was carried out for 2 hours while stirring at a reflux temperature.

After completion of the reaction, under reduced pressure, toluene solvent was removed to obtain Resin A of the present invention by reacting a carboxy group and the metal compound.

The molecular weight distribution of this Resin A was measured by gel permeation chromatography (HLC-802UR, $GMH_6$ column, available from Toyo Soda Co.), and consequently it was found to have local maximum values at $1.1\times10^4$ and $3.1\times10^5$ of a bimodal distribution. Also, a weight average molecular weight (Mw) was 128,000 and Mw/Mn was 12.8.

SYNTHESIS EXAMPLE 2

Resin B was prepared in the same manner as in Synthesis example 1, except for:

preparing a higher molecular weight polymer component by use of 240 g of styrene, 60 g of n-butyl acrylate and 0.9 g of benzoyl peroxide, preparing a lower molecular weight polymer component by use of 330 g of styrene, 35 g of α-methylstyrene, 245 g of n-butyl methacrylate, 70 g of monoacryloyloxyethyl isophthalate and 35 g of benzoyl peroxide, and using 23 g of zinc oxide as a metal compound.

Resin B had local maximum values at 8,400 and $2.6\times10^6$ in the molecular weight distribution, and Mw was 108,000 and Mw/Mn=13.5.

SYNTHESIS EXAMPLE 3

Resin C. was prepared in the same manner as in Synthesis example 1, except for:

preparing a higher molecular weight polymer component by use of 120 g of styrene, 40 g of 2-ethylhexyl acrylate, 40 g of methyl methacrylate and 0.4 g of benzoyl peroxide, preparing a lower molecular weight polymer component by use of 560 g of styrene, 120 g of 2-ethylhexyl acrylate, 120 g of methyl methacrylate, 80 g of monoacryloyloxypropyl succinate and 32 g of benzoyl peroxide, and using 15 g of magnesium oxide as a metal compound.

Resin C. had local maximum values at $1.2\times10^4$ and $5.1\times10^5$ in the molecular weight distribution, and Mw was 132,000 and Mw/Mn=12.0.

SYNTHESIS EXAMPLE 4

Resin D was prepared in the same manner as in Synthesis example 1, except for:

preparing a higher molecular weight polymer component by use of 400 g of styrene, 160 g of n-butyl methacrylate, 40 g of methyl methacrylate and 1.6 g of benzoyl peroxide, preparing a lower molecular weight polymer component by use of 180 g of styrene, 120 g of α-methylstyrene, 180 g of n-butyl methacrylate, 60 g of methyl methacrylate, 60 g of monoacryloyloxypropyl isophthalate and 30 g of benzoyl peroxide, and using 6.0 g of zinc oxide as a metal compound.

Resin D had local maximum values at $4.8\times10^3$ and $2.2\times10^5$ in the molecular weight distribution, and Mw was 103,000 and Mw/Mn=23.8.

SYNTHESIS EXAMPLE 5

Resin E was prepared in the same manner as in Synthesis example 1, except for:

preparing a higher molecular weight polymer component by use of 235 g of styrene, 10 g of n-butyl acrylate, 10 g of 2-ethylhexyl acrylate, 30 g of methyl methacrylate, 15 g of monoacryloyloxyethyl succinate and 0.9 g of benzoyl peroxide, preparing a lower molecular weight polymer component by use of 385 g of styrene, 35 g of α-methylstyrene, 50 g of n-butyl acrylate, 55 g of 2-ethylhexyl acrylate, 105 g of methyl methacrylate, 70 g of monoacryloyloxyethyl succinate and 35 g of benzoyl peroxide, and using 10 g of zinc oxide as a metal compound.

Resin E had local maximum values at $8.8\times10^3$ and $3.7\times10^5$ in the molecular weight distribution, and Mw was 131,000 and Mw/Mn=16.4.

SYNTHESIS EXAMPLE 6

Resin F was prepared in the same manner as in Synthesis example 1, except for:

preparing a higher molecular weight polymer component by use of 240 g of styrene, 60 g of n-butyl acrylate, 40 g of methyl methacrylate and 0.9 g of benzoyl peroxide, preparing a lower molecular weight polymer component by use of 420 g of styrene, 35 g of α-methylstyrene, 105 g of n-butyl acrylate, 105 g of methyl methacrylate, 35 g of monoacryloyloxyethyl succinate and 28 g of benzoyl peroxide, and using 5.0 g of zinc oxide as a metal compound.

Resin F had local maximum values at $1.0\times10^4$ and $2.9\times10^5$ in the molecular weight distribution, and Mw was 124,000 and Mw/Mn=13.1.

SYNTHESIS OF COMPARATIVE RESIN

COMPARATIVE SYNTHESIS EXAMPLE 1

In the same manner as in Synthesis example 1 except for removing 8 g of zinc oxide, Resin G was obtained.

Resin G had local maximum values at $1.0\times10^4$ and $3.1\times10^5$ in the molecular weight distribution, and Mw was 126,000 and Mw/Mn=13.5.

COMPARATIVE SYNTHESIS EXAMPLE 2

In 2 liter of separable flask was charged 400 g of toluene, and after air was replaced with a nitrogen gas, this system was heated to a boiling point of toluene and into this system was added dropwise 2.5 hours a solution of 750 g of styrene, 200 g of n-butyl acrylate, 50 g of monoacryloyloxyethyl succinate and 10 g of benzoyl peroxide as an initiator dissolved therein to carry out the solution polymerization.

After completion of dropwise addition, at the boiling point of toluene, the mixture was matured for 1 hour while stirring, and 14.1 g of zinc oxide was introduced therein.

Next, while gradually elevating the temperature of the system by 180 ° C., tolene was removed under reduced pressure to remove the solvent to prepare Resin H which was a reaction polymer of styrene-n-butyl acrylate-monoacryloyloxyethyl succinate and zinc oxide.

COMPARATIVE SYNTHESIS EXAMPLE 3

In a separable flask was charged with 90 g of xylene, and further 75 g of styrene, 20 g of butyl acrylate, 5 g of monobutyl maleate and 0.5 g of divinyl benzene were added therein. After a gas phase was replaced with a nitrogen gas, while maintaining the system at 80 ° C., a solution of 10 g of xylene dissolved 1.2 g of benzoyl peroxide therein was added and stirring was continued for 10 hours. Thereafter, the system was elevated to 95 ° C. and maintained for 3 hours to complete the polymerization. After cooling, the polymer solution was poured into a large amount of methanol, and precipitates were collected by filtration and sufficiently dried at 50 ° C. Resin I herein obtained had Mw/Mn of 27 and Mw of 233,000.

Preparation of toner 100 parts by weight each of Resins A to F obtained in the above Synthesis examples 1 to 6, 10 parts by weight of carbon black (trade name "MOGAL L", available from Cabot Co.), 2 parts by weight of polypropylene (Biscoal 660P, trade name, available from Sanyo Kasei Kogyo Co.) and 2 parts by weight of Wax-E (trade name, available from Höechst Co.) were mixed with a henshell mixer, and then fused and kneaded at a temperature of 130 ° C. with a twin roll. Subsequently, after allowed to stand for cooling, and coarsely pulverized, it was pulverized by means of a jet mill and classified to obtain Toners 1 to 6 according to the present invention having an average particle size of 11.0 μm.

Preparation of comparative toner

Comparative toner (1)

In the same manner as in the above Toner 1 except for using a mixture of 100 parts by weight of Resin G and 10 parts by weight of carbon black ("MOGAL L", trade name, available from Cabot co.), comparative toner (1) was obtained.

Comparative toner (2)

100 parts by weight of Resin H and 5 parts by weight of carbon black ("Diablack SH", trade name, available from Mitsubishi Chemical Industry Co.) were fused and kneaded, and coarsely pulverized after cooling, and finely pulverized by means of a jet mill to obtain comparative toner (2) having an average particle diameter of about 13 to 15 μm.

Comparative toner (3)

In a small size pressure kneader, 100 parts by weight of Resin I, 5 parts by weight of zinc salt of di-t-butyl salycilic acid, 8 parts by weight of carbon black and 4 parts by weight of a metal salt dye (trade name; Sapon Fast Black B, C.I. Acod Black, available from BASF Co.) were sufficiently fused and kneaded. After cooling, it was finely pulverized and selected particles having about 5 to 20 μm to obtain comparative toner (3).

Preparation of developer of the present invention

EXAMPLE 5

After mixing 49.75 parts by weight of Toner 1 and 0.25 parts by weight of hydrophobic silica (Areosil R-972, trade name, available from Aerosil Co.), it was further mixed with 950 parts by weight of Carrier A to obtain Developer-1 of the present invention.

By using the above Developer-1, formation and development of an electrostatic image using an electrophotogrpahic copying machine "U-Bix 5000" (available from Konishiroku Photo Industry Co., Ltd.) were carried out, and the resulting toner image was transferred onto a transfer paper and fixed with a heating roller fixing device to carry out practical copying test to form a copied image. And by the following method, a minimum fixing temperature (minimum temperature of a heating roller capable of carrying out fixation) and offset generating temperature (minimum temperature generating offset phenomenon) were measured.

Minimum fixing temperature:

After unfixed image was formed by the above copying machine, by using a fixing device comprising a thermal roller having a diameter of 50 a surface layer of which was formed by Teflon (trade name, polytetrafluoroethylen, available from Du'Pont Co.) and a pressure roller a surface layer of which was formed by a silicone rubber "KE-1300RTV" (trade name, available from Shin-etsu Kagaku Kogyo Co.), a toner image according to a sample toner transferred to a transfer paper having 64 g/m$^2$ was treated for fixation with the conditions of 200 mm/sec of line speed, 0.8 kg/cm of line pressure and 8.0 mm of nip width. By setting the temperature of the thermal roller in the range of 100° to 240 ° C. and by raising the temperature every 5° C. stepwisely, the above operation was repeated at each temperature and a fixed image formed at each temperature was rubbed with a thin paper (Kimwipe, trade name). Minimum fixing temperature was determined with the minimum setting temperature of fixing image which shows sufficient rubbing resistance.

Offset generating temperature:

Measurement of offset generating temperature is according to the measurement of the minimum fixing temperature. But it was carried out as follows: After forming the unfixed image by the above copying machine, a toner image was transferred and fixing treatment was effected by the above fixing device, and then a white paper for transfer paper was introduced into the fixing device under the same conditions. The operation of visual observation whether stain was generated on the paper or not was repeated in the state of stepwisely raising the temperature of the thermal roller in the above fixing device, and a minimum temperature of which stain due to the toner was generated was determined as the offset generating temperature.

Further, as to the above toner, blocking resistance was measured as follows:

Blocking resistance:

Blocking resistance test was carried out by leaving a sample under the circumferential conditions of at a temperature of 55° C. and a relative humidity of 60% for 1 day and observed whether agglomerates were generated or not.

Next, by using the above developer, under circumferential conditions of a normal temperature and normal humidity (20° C. and 60% RH) and a high temperature and high humidity (30% and 80% RH), copying tests over 100,000 papers were carried out and the following evaluations were carried out.

Image quality:

At an initial stage and a final stage of 100,000 times of developing processes, sharpness of copied image was examined.

Filming resistance:

The filming resistance was evaluated by examining presence or absence of an adhered material on a surface of the carrier, a surface of the photoreceptor and a cleaning blade with an electron microscope or with eyes at an initial stage and a final state of 100,000 times of developing processes.

The results are as shown in Table 3. In the table, "good" as to image quality means sharp in image and "not good" means the resulting image is remarkable in fog and unclear.

Fog:

It was shown by a relative density to a developed image of the white ground portion having a copy density of 0.0 (white ground reflective density is made 0.0).

O not more than 0.01

Δ 0.01 to not more than 0.03

X 0.03 or higher

Cleaning property:

The cleaning property was judged from presence or absence of an adhered material by observing a surface of the photoreceptor after cleaning of the surface of the photoreceptor with a cleaning material.

The results are shown in Table 3.

EXAMPLES 6 to 10

In the same manner as in Example 5, after Toners 2, 3, 4, and 6 are each mixed with a hydrophobic silica, Carrers B, C, D, E and F according to the present invention were combinedly mixed, respectively, to prepare Developers-2 to 6, and tests were carried out in the same manner as in Example 5. The results are shown in the following Table 3.

COMPARATIVE EXAMPLE 4

By mixing 5 parts by weight of comparative toner (1) and 95 parts by weight of comparative carrier (b) to obtain Comparative developer-(1).

By using this Comparative developer-(1), tests were carried out in the same manner as in Example 5. The results are shown in Table 3.

COMPARATIVE EXAMPLE 5

By mixing 4 parts by weight of comparative toner (2) and 96 parts by weight of comparative carrier (b) of iron powder to obtain Comparative developer-(2), and tests were carried out in the same manner as in Example 5. The results are shown in Table 3.

COMPARATIVE EXAMPLE 6

By mixing 10 parts by weight of comparative toner (3) and 90 parts by weight of comparative carrier (b) to obtain Comparative developer-(3), and tests were carried out in the same manner as in Example 5. The results are shown in Table 3.

COMPARATIVE EXAMPLE 7

By mixing 5 parts by weight of comparative toner (1) and 95 parts by weight of comparative carrier (a) to obtain Comparative developer-(4), and tests were carried out in the same manner as in Example 5. The results are shown in Table 3.

TABLE 3

| | Developer | Toner | Carrier | Minimum fixing temperature (°C.) | Offset generating temperature (°C.) | Blocking resistance |
|---|---|---|---|---|---|---|
| Example 5 | 1 | 1 | A | 125 | 230 | no agglomerates |
| Example 6 | 2 | 2 | B | 120 | 220 | no agglomerates |
| Example 7 | 3 | 3 | C | 125 | 230 | no agglomerates |
| Example 8 | 4 | 4 | D | 125 | 230< | no agglomerates |
| Example 9 | 5 | 5 | E | 120 | 220 | no agglomerates |
| Example 10 | 6 | 6 | F | 125 | 230 | no agglomerates |
| Comparative example 4 | (1) | (1) | (b) | 160 | 230 | no agglomerates |
| Comparative example 5 | (2) | (2) | (b) | 160 | 230 | no agglomerates |
| Comparative example 6 | (3) | (3) | (b) | 150 | 220 | no agglomerates |
| Comparative example 7 | (4) | (4) | (a) | 160 | 230 | no agglomerates |

| | 100,000 papers copying test normal temperature and humidity | | | | 100,000 papers copying test (high temperature and humidity) | | | |
|---|---|---|---|---|---|---|---|---|
| | Fog | Cleaning property | Filming | Image quality | Fog | Cleaning property | Filming | Image quality |
| Example 5 | O | Good | None | Clear | O | Good | None | Clear |
| Example 6 | O | Good | None | Clear | O | Good | None | Clear |
| Example 7 | O | Good | None | Clear | O | Good | None | Clear |
| Example 8 | O | Good | None | Clear | O | Good | None | Clear |
| Example 9 | O | Good | None | Clear | O | Good | None | Clear |
| Example 10 | O | Good | None | Clear | O | Good | None | Clear |
| Comparative example 4 | (X) after 5000 papers | Cleaning defect occured from 17000 papers | Present | Blurred after 8000 papers | (X) after 2000 papers | Cleaning defect occured from 14000 papers | Present | Blurred after 2500 papers |
| Comparative example 5 | (X) after 13000 papers | Cleaning defect occured from 13000 papers | Present | Blurred after 13000 papers | (X) after 2500 papers | Cleaning defect occured from 5000 papers | Present | Blurred after 5000 papers |
| Comparative example 6 | (X) after 8000 papers | Cleaning defect occured from 8000 papers | Present | Blurred after 8000 papers | (X) after 2000 papers | Cleaning defect occured from 2500 papers | | Blurred after 2500 papers |
| Comparative example 7 | (X) after 20000 papers | Cleaning defect occured from 17000 papers | Present | Blurred after 15000 papers | (X) after 8000 papers | Cleaning defect occured from 14000 papers | Present | Blurred after 8000 papers |

As shown in Table 3, in Developers 1 to 6 of the present invention, they are excellent in low temperature fixability, offset resistance and blocking resistance and have broad fixable range. Also, under the normal temperature and normal humidity, and high temperature and high humidity circumferential conditions, no fog is generated, cleaning property is good, and no fusion to a surface of the photoreceptor or to a cleaning blade. Further, they are excellent in friction chargeability, and excellent in durability, and in temperature and humidity resistance whereby stable and sharp image can be obtained for a long term.

To the contrary, in Comparative developer-(1), low temperature fixability is inferior to those of the present invention, and due to lower molecular component, durability is also inferior according to stain of the carrier, etc. Particularly, under the conditions of high temperature and high humidity, due to generation of filming, durability is bad. Also, in Comparative developer-(2), it is not only bad in low temperature fixability but also is not good in durability. Particularly, under the conditions of high temperature and high humidity, due to generation of filming, unstabilization of the friction chargeability and poor cleaning are caused, whereby only unclear image can be obtained and it is bad in durability, and temperature and humidity resistance.

Further, in Comparative developer-(3), it is bad in low temperature fixability and offset resistance, and it can be considered that cross-linking reaction due to a metal do not smoothly proceed, and filming property is bad and durability is not good. Particularly, under the conditions of high temperature and high humidity, due to unstability of friction charging such as generations of filming and failure of cleaning, image obtained becomes unclear whereby it is inferior in durability, and temperature and humidity resistance.

In Comparative developer-(4), since it is 15,000 sheets under normal temperature and normal humidity and is 8,000 sheets under high temperature and high humidity, it is inferior to that of the present invention in durability.

Preparation of carrier (1) Carrier G 8 parts by weight of a condensation reaction type silicone resin "SR-2400" (trade name, available from Toray Silicone Co.) was sprayed to 100 parts by weight of spherical copper-zinc ferrite particles (available from Nippon Tappun Co.) having an average particle size of 70 μm by using a fluidized bed apparatus, and they are further heat treated at 200° C. for 1 hour. Then, agglomerates were sifted to obtain Carrier G coated with a silicone resin and having a volume average particle size of 72 μm.

(2) Carrier H

In the same manner as in Carrier G except for using "SR-2406" as a condensation reaction type silicone resin and spherical copper-zinc ferrite particles having an average particle size of 60 μm, Carrier H having a volume average particle size of 62 μm was obtained.

Synthesis of toner resin

Synthesis example 7

Resin J was prepared in the same manner as in Synthesis example 1, except for:

preparing a higher molecular weight polymer component by use of 240 g of styrene, 60 g of n-butyl acrylate and 0.6 g of benzoyl peroxide, preparing a lower molecular weight polymer component by use of 490 g of styrene, 140 g of butyl acrylate, 70 g of monoacryloyloxyethyl isophthalate and 35 g of benzoyl peroxide, and using 10 g of zinc oxide as a metal compound.

Resin J had local maximum values at $9.5\times10^3$ and $3.2\times10^5$ in the molecular weight distribution, and Mw was 121,000 and Mw/Mn=12.5.

SYNTHESIS EXAMPLE 8

Resin K was prepared in the same manner as in Synthesis example 1, except for:

preparing a higher molecular weight polymer component by use of 165 g of styrene, 120 g of n-butyl methacrylate, 15 g of methyl methacrylate and 0.5g of benzoyl peroxide, preparing a lower molecular weight polymer component by use of 250 g of styrene, 35 g of α-methylstyrene, 210 g of n-butyl methacrylate, 70 g of methyl methacrylate, 100 g of monoacryloyloxyethyl isophthalate and 35 g of benzoyl peroxide, and using 46 g of zinc acetate as a metal compound.

Resin K had local maximum values at $6.2\times10^3$ and $3.8\times10^5$ in the molecular weight distribution, and Mw was 3,000 and Mw/Mn=23.8.

SYNTHESIS EXAMPLE 9

Resin L was prepared in the same manner as in Synthesis example 1, except for:

preparing a higher molecular weight polymer component by use of 225 g of styrene, 60 g of 2-ethylhexyl acrylate, 5 g of monoacryloyloxyethyl succinate and 0.5 g of benzoyl peroxide, preparing a lower molecular weight polymer component by use of 480 g of styrene, 105 g of 2-ethylhexyl acrylate, 80 g of monoacryloyloxyethyl succinate and 35 g of benzoyl peroxide, and using 20 g of magnesium oxide as a metal compound.

Resin L had local maximum values at 5.6×103 and $3.6\times10^5$ in the molecular weight distribution, and Mw was 28,000 and Mw/Mn=25.1.

SYNTHESIS EXAMPLE 10

Resin M was prepared in the same manner as in Synthesis example 1, except for:

preparing a higher molecular weight polymer component by use of 180 g of styrene, 60 g of n-butyl methacrylate and 0.4 g of benzoyl peroxide, preparing a lower molecular weight polymer component by use of 490 g of styrene, 140 g of n-butyl acrylate, 50 g of monoacryloyloxyethyl succinate and 35 g of benzoyl peroxide, and using 5 g of zinc oxide as a metal compound.

Resin M had local maximum values at $4.3\times10^3$ and $4.1\times10^5$ in the molecular weight distribution, and Mw was 39,000 and Mw/Mn=34.7.

Synthesis of comparative resin

COMPARATIVE SYNTHESIS EXAMPLE 4

In the same manner as in Synthesis example 7 except for removing 10 g of zinc oxide, Resin N was obtained.

Resin N had local maximum values at $8.3\times10^3$ and $3.2\times10^5$ in the molecular weight distribution, and Mw was 115,000 and Mw/Mn=13.2.

COMPARATIVE SYNTHESIS EXAMPLES 5 and 6

In the same manner as in Comparative synthesis examples 2 and 3, Resins O and P were obtained.

Preparation of toner 100 parts by weight each of Resins J and K obtained in the above Synthesis examples 7 and 8, 10 parts by weight of carbon black (trade name "MOGAL L", available from Cabot Co.), 2 parts by weight of polypropylene (Biscoal 660P, trade name, available from Sanyo Kasei Kogyo Co.) and 2 parts by weight of Wax-E (trade name, available from Höechst Co.) were mixed with a henshell mixer, and then fused and kneaded at a temperature of 130° C. with a twin roll. Subsequently, after allowed to stand for cooling, and coarsely pulverized, it was pulverized by means of a jet mill and classified to obtain Toners 7 and 8 according to the present invention having an average particle size of 11.0 μm.

100 parts by weight each of Resins L and M obtained in the above Synthesis examples 9 and 10, 10 parts by weight of carbon black (trade name "Reagal 660R", available from Cabot Co.), 2 parts by weight of polypropylene (Biscoal 660P, trade name, available from Sanyo Kasei Kogyo Co.), 2 parts by weight of Wax-E (trade name, available from Höechst Co.) and 3 parts by weight of Nigrosin EX (trade name, available from Orient Kagaku Co.) were mixed with a henshell mixer, and then fused and kneaded at a temperature of 130° C. with a twin roll. Subsequently, after allowed to stand for cooling, and coarsely pulverized, it was pulverized by means of a jet mill and classified to obtain Toners 9 and 10 according to the present invention having an average particle size of 11.0 μm.

Preparation of comparative toner

Comparative toner (5)

In the same manner as in the above Toner 7 except for using a mixture of 100 parts by weight of Resin N and 10 parts by weight of carbon black ("MOGAL L", trade name, available from Cabot co.), comparative toner (5) was obtained.

Comparative toner (6)

0 parts by weight of Resin 0 and 5 parts by weight of carbon black ("Diablack SH", trade name, available from Mitsubishi Chemical Industry Co.) were fused and kneaded, and coarsely pulverized after cooling, and finely pulverized by means of a jet mill to obtain comparative toner (6) having an average particle diameter of about 13 to 15

Comparative toner (7)

In a small size pressure kneader, 100 parts by weight of Resin P, 5 parts by weight of zinc salt of di-t-butyl salycilic acid, 8 parts by weight of carbon black and 4 parts by weight of a metal salt dye (trade name; Sapon Fast Black B, C.I. Acod Black, available from BASF Co.) were sufficiently fused and kneaded. After cooling, it was finely pulverized and selected particles having about to 20 μm to obtain comparative toner (3).

Preparation of developer of the present invention

EXAMPLE 11

After mixing 49.5 parts by weight of Toner 7 and 0.5 parts by weight of hydrophobic silica (Areosil R-972, trade name, available from Aerosil Co., BET specific surface area: 110 $m^2/g$, average particle size of primary particle: 6 mμ), it was further mixed with 950 parts by weight of Carrier G to obtain Developer-7 of the present invention.

By using the above Developer-7, formation and development of a positive electrostatic latent image using an electrophotogrpahic copying machine "U-Bix 5000" (available from Konishiroku Photo Industry Co., Ltd.) were carried out, and the resulting toner image was transferred onto a transfer paper and fixed with a heating roller fixing device to carry out practical copying test to form a copied image. Then, in the same manner as in Examples 6 to 10, minimum fixing temperature, offset generating temperature, blocking resistance temperature, fog and image quality were measured.

Further, as to the above toner, fluidity, chargeability, image density, toner dissipation were measured as follows:

Fluidity of the developer:

The developer was placed in a developing device and stirred, and fluidity was measured with eyes.

Chargeability:

After the above developer was shaked for 10 minutes with a shaking apparatus "Nes-YS" (trade name, available from Yayoi Seisakusho Co.), an amount of charge Q/M (unit: microcoulomb 1 g) per unit weight in the toner by the blow off method.

Image density:

By the use of Sakura Densitometer (available from Konishiroku Photo Industry Co., Ltd.), a reflection density to the developed image at the black portion having a copy density of 1.5 was measured.

Toner dissipation:

After carried out 10,000 times of copying at the normal temperature and normal humidity (20° C., 60% RH) and the high temperature and high humidity (30° C., 80% RH), dissipation state of the toner in the copying machine was evaluated with eyes.

The results are shown in Table 4.

EXAMPLE 12

After mixing 49.7 parts by weight of Toner 8 and 0.3 parts by weight of hydrophobic silica (Areosil R-812, trade name, available from Aerosil Co., BET specific surface area: 200 $m^2/g$, average particle size of primary particle: 7 mμ), it was further mixed with 950 parts by weight of iron powder carrier (DSP-138) to obtain Developer-8 of the present invention, and tests were carried out in the same manner as in Example 11. The results are shown in Table 4 below.

EXAMPLE 13

After mixing 49.6 parts by weight of Toner 9 and 0.4 parts by weight of hydrophobic titanium oxide (P-25, trade name, available from Aerosil Co., BET specific surface area: 50 m2/g, average particle size of primary particle: 21 mμ), it was further mixed with 950 parts by weight of iron powder carrier (DSP-138) to obtain Developer-9 for negative electrostatic latent image development of the present invention. Tests were carried out in the same manner as in Example 11 except for carrying out formation of electrostatic latent image by using a modified apparatus of electrophotographic copying machine "U-Bix-2500" (trade name, available from Konishiroku Photo Industry Co., Ltd.) having a photoreceptor comprising an organic semiconductor which forms a negative electrostatic latent image. The results are shown in Table 4 below.

EXAMPLE 14

After mixing 49 parts by weight of Toner 10 and 1 parts by weight of hydrophobic alumina (Aluminium Oxide C, trade name, available from Aerosil Co., BET specific surface area: 100 $m^2/g$, average particle size of primary particle: 20 mμ), it was further mixed with 950 parts by weight of iron powder carrier (DSP-138) to obtain Developer-10 for negative electrostatic latent image development of the present invention, and tests were carried out in the same manner as in Example 13. The results are shown in Table 4 below.

COMPARATIVE EXAMPLE 8

By mixing 5 parts by weight of comparative toner (5) and 95 parts by weight of iron powder carrier (DSP-138) to obtain Comparative developer-(5). By using this Comparative developer-(5), tests were carried out in the same manner as in Example 11. The results are shown in Table 4.

COMPARATIVE EXAMPLES 9 to 11

After mixing 49.5 parts by weight of Comparative toners (5) to (7) and 0.5 parts by weight of hydrophobic silica (R-972, trade name), it was further mixed with 950 parts by weight of iron powder carrier (DSP-138) to obtain Comparative developers-(6) to (8) for positive electrostatic latent image development, and tests were carried out in the same manner as in Example 11. The results are shown in Table 4 below.

TABLE 4

| | Minimum fixing temperature (°C.) | Offset generating temperature (°C.) | Blocking resistance | Fluidity of developer | Chargeability (μc/g) | Image density |
|---|---|---|---|---|---|---|
| Developer 7 | 120 | 240 | no agglomerates | Good | −22 | 1.35 |
| Developer 8 | 125 | 240 or higher | no agglomerates | Good | −24 | 1.32 |
| Developer 9 | 125 | 240 or higher | no agglomerates | Good | +20 | 1.40 |
| Developer 10 | 120 | 240 | no agglomerates | Good | +19 | 1.30 |
| Comparative developer (5) | 140 | 210 | no agglomerates | Bad | −10 | 0.54 |
| Comparative Developer (6) | 160 | 220 | no agglomerates | Slightly bad | −11 | 0.71 |
| Comparative Developer (7) | 160 | 220 | no agglomerates | Slightly bad | −13 | 0.73 |
| Comparative Developer (8) | 150 | 210 | no agglomerates | Slightly bad | −11 | 0.65 |

| | Toner dissipation at normal temperature and normal humidity | Fog at high temperature and high humidity | Fog | Image quality at normal temperature and normal humidity | Image quality at high temperature and high humidity |
|---|---|---|---|---|---|
| Developer 7 | Slight | Slight | O | Clear | Clear |
| Developer 8 | Slight | Slight | O | Clear | Clear |
| Developer 9 | Slight | Slight | O | Clear | Clear |
| Developer 10 | Slight | Slight | O | Clear | Clear |
| Comparative developer (5) | Extreme | Extreme | X | Blurred | Blurred |
| Comparative Developer (6) | Extreme | Extreme | X | Blurred | Blurred |
| Comparative Developer (7) | Extreme | Extreme | X | Blurred | Blurred |
| Comparative Developer (8) | Extreme | Extreme | X | Blurred | Blurred |

As shown in Table 4, in Developers 7 to 10 of the present invention, they are excellent in low temperature fixability, offset resistance and blocking resistance and have broad fixable range. Also, under the normal temperature and normal humidity, and the high temperature and high humidity circumferential conditions, they have advantages that fluidity is good, friction chargeability is excellent, no fog is generated, image density is high, no dissipation of the toner is generated, cleaning property is good, and no fusion to the carrier, a surface of the photoreceptor or a cleaning blade. Further, they are excellent in durability, and in temperature and humidity resistance whereby stable and sharp image can be obtained for a long term.

To the contrary, in Comparative developer-(5), due to brittle lower molecular weight component which in not ion cross-linked, toner dissipation is generated by stain of the carrier, etc., whereby it is bad in durability. Particularly, under the high temperature and high humidity conditions, according to generation of filming, toner dissipation is generated whereby it is bad in durability. Further, it is also inferior to those of the present invention in offset resistance, chargeability and image density. Also, in Comparative developer-(6), it is not only bad in low temperature fixability but also is not good in fluidity of the developer. Further, it is also inferior in friction chargeability and image density, and yet toner dissipation is generated so that the image obtained is blurred, thus it is bad in durability. Moreover, under the high temperature and high humidity conditions, due to generation of filming, etc., unstabilization of the friction chargeability, poor cleaning and toner dissipation are caused, whereby only blurred image can be obtained and it is bad in durability, and temperature and humidity resistance. Further, in Comparative developers-(7) and (8), they are substantially the same results as in Comparative developer(6), and they are inferior to those of the present invention in durability, temperature and humidity resistance, etc.

We claim:

1. A toner for developing an electrostatic image comprising a mixture of a lower molecular weight polymer component and a higher molecular weight polymer toner said lower molecular weight polymer component being a resin obtained by reacting a polymer comprising a styrene monomer, an acrylate or methacrylate monomer, and a half-ester compound obtained by esterification reaction of an acrylic acid derivative having a hydroxy group or a methacrylic acid derivative having a hydroxy group, with a dicarboxylic acid;

with a polyvalent metal compound to form cross-linking through the metal atom, a local maximum value of said lower molecular weight polymer component being $1\times10^3$ to $2\times10^4$, a local maximum value of said higher molecular weight polymer component being $1\times10^5$ to $2\times10^6$, said toner further containing an offset preventive agent.

2. The toner for development of electrostatic image according to claim 1, wherein both of said lower molecular weight polymer component and said higher molecular weight polymer component are obtained by (a) a styrene type monomer, (b) an acrylate or methacrylate type monomer and (c) a half ester compound obtained by esterification reaction having a hydroxyl group with a dicarboxylic acid, respectively.

3. The toner for development of electrostatic image according to claim 2, wherein said half ester compound is represented by the following formula:

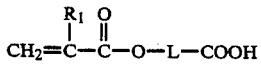

(I)

wherein $R_1$ represents a hydrogen atom or a methyl group and L represents a divalent linking group having an ester bonding in the molecular chain and having 3 or more carbon atoms, which may have a substituent(s).

4. The toner for development of electrostatic image according to claim 3, wherein said L in the formula is a divalent bonding group represented by:

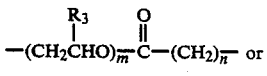

or

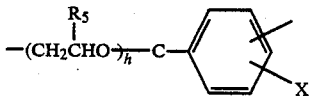

wherein $R_3$ and $R_5$ each represent a hydrogen atom or a methyl group, m and h each are an integer of 1 to 14 n is an integer of 0 to 8, and X represents a hydrogen atom, a halogen group element, a lower alkyl group or an alkoxy group 5. The toner for development of electrostatic image according to claim 1, wherein said metal compound is a compound of zinc or an alkaline earth metal.

6. The toner for development of electrostatic image according to claim 1, wherein said offset preventive agent is a non-polar substance and/or a polar substance.

7. The toner for development of electrostatic image according to claim 1, wherein said offset preventive agent is a non-polar substance or a mixture of a non-polar substance and a polar substance.

8. The toner for development of electrostatic image according to claim 6, wherein said non-polar substance is a polyolefin and said polar substance is an aliphatic acid ester and/or an alkylenebisaliphatic amide.

9. The toner for development of electrostatic image according to claim 1, wherein said offset preventive agent is a polyolefin and an aliphatic acid ester or an alkylenebisaliphatic amide.

10. An electrostatic image developer comprising toner particles containing a resin obtained by reacting a carboxy group of a polymer component with a polyvalent metal compound and, magnetic carrier particles surface coated with a fluorine-containing resin, said toner particles having a molecular weight distribution into at least a lower molecular weight polymer component and a higher molecular weight polymer component, a local maximum value of said lower molecular weight polymer component being $1\times10^3$ to $2\times10^4$, a local maximum value of said higher molecular weight polymer component being $1\times10^5$ to $2\times10^6$, said lower molecular weight polymer component being a resin obtained by reacting a polymer comprising a stryene monomer, an acrylate or methacrylic monomer, and a half-ester compound obtained by esterification reaction of an acrylic acid derivative having a hydroxy group or methacrylic acid derivative having a hydroxy group, with a dicarboxylic acid.

11. The electrostatic latent image developer according to claim 10, wherein said metal compound is a zinc group compound or an alkaline earth metal compound.

12. The electrostatic latent image developer according to claim 10, wherein said fluorine-containing resin is represented by the following formula (VI):

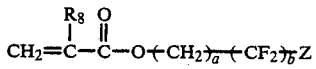

(VI)

wherein $R_8$ represent a hydrogen atom or a methyl group, a is an integer of 1 to 8 and b is an integer of 1 to 19.

13. The electrostatic latent image developer according to claim 12, wherein said fluorine-containing resin is a vinylidene fluoride-tetrafluoro ethylene copolymer.

14. The electrostatic latent image developer according to claim 13, wherein said inorganic fine particles are hydrophobic silica fine particles.

15. An electrostatic image developer comprising toner particles containing a resin obtained by reacting a carboxy group with a polymer component with a polyvalent metal compound and, inorganic fine particles said toner particles having a molecular weight distribution divided into at least a lower molecular weight polymer component and a high molecular weight polymer component, a local maximum value of said lower molecular weight polymer component being $1\times10^3$ to $2\times10^4$, a local maximum value of said higher molecular weight polymer component being $1\times10^5$ to $2\times10^6$, said lower molecular weight polymer component being a resin obtained by reacting a polymer comprising a styrene monomer, an acrylate or methacrylate monomer, and a half-ester compound obtained by esterification reaction of an acrylic acid derivative having a hydroxy group or methacrylic acid derivative having a hydroxy group, with a dicarboxylic acid;

with a polyvalent metal compound to form cross-linking through the metal atom.

16. The electrostatic latent image developer according to claim 15, wherein said half-ester compound is represented by the following formula:

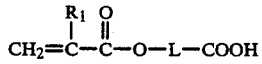

(I)

wherein $R_1$ represents a hydrogen atom or a methyl group and L represents a divalent linking group having an ester bonding in the molecular chain and having 3 or more carbon atoms, which may have a substituent(s).

17. The electrostatic latent image developer according to claim 15, wherein said metal compound is a zinc group compound or an alkaline earth metal compound.

18. The electrostatic latent image developer according to claim 15, wherein said fluorine-containing resin is represented by the following formula (VI):

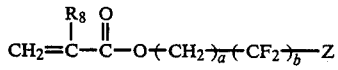

(VI)

wherein $R_8$ represents a hydrogen atom or a methyl group, a is an integer of 1 to 8 and b is an integer of 1 to 19.

* * * * *